US010502440B2

(12) United States Patent
Kwon et al.

(10) Patent No.: US 10,502,440 B2
(45) Date of Patent: Dec. 10, 2019

(54) MULTI-PULSE JET GENERATOR AND AIR CONDITIONER HAVING SAME

(71) Applicants: Samsung Electronics Co., Ltd., Suwon-si (KR); SEOUL NATIONAL UNIVERSITY R&DB FOUNDATION, Seoul (KR)

(72) Inventors: Ki Hwan Kwon, Hwaseong-si (KR); Jin Wook Yoon, Yongin-si (KR); Eun Bi Seo, Geoje-si (KR); Min Hee Kim, Seoul (KR); Chong Am Kim, Seoul (KR); Byung Hyun Lee, Daegu (KR)

(73) Assignees: SAMSUNG ELECTRONICS CO., LTD., Suwon-si (KR); SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 311 days.

(21) Appl. No.: 15/306,961

(22) PCT Filed: Apr. 13, 2015

(86) PCT No.: PCT/KR2015/003676
§ 371 (c)(1),
(2) Date: Oct. 26, 2016

(87) PCT Pub. No.: WO2015/167143
PCT Pub. Date: Nov. 5, 2015

(65) Prior Publication Data

US 2017/0045247 A1 Feb. 16, 2017

(30) Foreign Application Priority Data

Apr. 30, 2014 (KR) ..... 10-2014-0052776

(51) Int. Cl.
*F04B 45/04* (2006.01)
*F24F 7/007* (2006.01)
(Continued)

(52) U.S. Cl.
CPC ..... *F24F 7/007* (2013.01); *F04B 45/04* (2013.01); *F04B 45/041* (2013.01);
(Continued)

(58) Field of Classification Search
CPC . F04F 7/00; F24F 7/007; F04B 45/041; F04B 45/04; F04B 43/046
(Continued)

(56) References Cited

U.S. PATENT DOCUMENTS 6,109,339 A * 8/2000 Talbert ..... F24H 1/43 165/48.1
8,308,452 B2 * 11/2012 Amirouche ..... F04B 43/046 417/413.2
(Continued)

FOREIGN PATENT DOCUMENTS

JP 2005-24229 1/2005
JP 2009-116202 5/2009
(Continued)

OTHER PUBLICATIONS

International Search Report dated Jul. 20, 2015 in corresponding International Application No. PCT/KR2015/003676.

*Primary Examiner* — Steven B McAllister
*Assistant Examiner* — Ko-Wei Lin
(74) *Attorney, Agent, or Firm* — Staas & Halsey LLP

(57) ABSTRACT

Provided is a multi-pulsed jets generating apparatus including: at least one actuator that generates pulsed jets in a plurality of orifices according to a volume change of a plurality of cavities caused by vibration of at least one diaphragm; and a manifold connected to the at least one actuator so as to generate multi-pulsed jets by receiving the pulsed jets occurring in the plurality of orifices. The velocity and uniformity of the pulsed jets occurring in the plurality of
(Continued)

injection ports can be controlled according to vibration phases of a plurality of diaphragms.

18 Claims, 35 Drawing Sheets

(51) Int. Cl.
*F24F 13/24* (2006.01)
*F24F 7/00* (2006.01)

(52) U.S. Cl.
CPC ..... *F04B 45/043* (2013.01); *F24F 13/24* (2013.01); *F24F 2007/005* (2013.01)

(58) Field of Classification Search
USPC ..... 417/413.2; 454/245–249
See application file for complete search history.

(56) References Cited

U.S. PATENT DOCUMENTS

| | | | | |
|---|---|---|---|---|
| 2009/0270023 | A1* | 10/2009 | Bartmann | E06B 7/10 454/198 |
| 2010/0150753 | A1* | 6/2010 | Busch | F04B 43/04 417/413.1 |

FOREIGN PATENT DOCUMENTS

| | | |
|---|---|---|
| KR | 10-2005-0108490 | 11/2005 |
| KR | 10-2008-0007438 | 1/2008 |
| KR | 10-2013-0077855 | 7/2013 |

* cited by examiner

MULTI-PULSE JET GENERATOR AND AIR CONDITIONER HAVING SAME

CROSS-REFERENCE TO RELATED APPLICATIONS

This application is a U.S. National Stage Application, which claims the benefit under 35 U.S.C. § 371 of PCT International Patent Application No. PCT/KR2015/003676, filed Apr. 13, 2015, which claims the foreign priority benefit under 35 U.S.C. § 119 of Korean Patent Application No. 10-2014-0052776, filed Apr. 30, 2014, the contents of which are incorporated herein by reference.

TECHNICAL FIELD

Embodiments of the present invention relate to a multi-pulsed jets generating apparatus that generates multi-pulsed jets in a large region and an air conditioner having the same.

BACKGROUND ART

In general, an air conditioner is a home appliance that cools or heats the interior by including a heat exchanger that exchanges heat between a refrigerant and air, a blower fan that forcibly flows the air, and a motor that drives the blower fan.

The air conditioner has inevitable noise, such as flow frictional nose caused by rotation of the blower fan and driving noise of the motor that drives the blower fan. This noise is increased as the rotation velocity of the blower fan increases.

Also, the heat exchanger and the blower fan should have an appropriate position relationship so that sufficient flow velocity of the air can be obtained and efficient heat exchanging can be performed. That is, the heat exchanger should be disposed to surround a cross fan according to a cylindrical shape of the cross fan that is generally used as the blower fan. Thus, there are limitations in minimization and improvements in design of the air conditioner.

DISCLOSURE

Technical Problem

It is an aspect of the present invention to provide a multi-pulsed jets generating apparatus that generates multi-pulsed jets in a large region.

It is another aspect of the present invention to provide a multi-pulsed jets generating apparatus that is capable of improving velocity and uniformity of multi-pulsed jets by mounting actuators on both ends of a manifold.

It is still another aspect of the present invention to provide an air conditioner having a small size, a thin shape and an improved design by omitting a blower fan and a motor installed in a conventional air conditioner.

It is yet still another aspect of the present invention to provide an air conditioner having improved heat-exchanging efficiency in which an injection angle of a multi-pulsed jets generating apparatus is optimized.

Additional aspects of the invention will be set forth in part in the description which follows and, in part, will be obvious from the description, or may be learned by practice of the invention.

Technical Solution

In accordance with one aspect of the present invention, a multi-pulsed jets generating apparatus includes: at least one actuator that generates pulsed jets in a plurality of orifices according to a volume change of a plurality of cavities caused by vibration of at least one diaphragm; and a manifold connected to the at least one actuator so as to generate multi-pulsed jets by receiving the pulsed jets occurring in the plurality of orifices.

The at least one actuator may include a first actuator and a second actuator disposed on both ends of the manifold, respectively.

The first actuator and the second actuator may generate pulsed jets by operating in the same phase.

The first actuator and the second actuator may generate pulsed jets by operating in opposite phases.

The first actuator and the second actuator may generate pulsed jets in opposite directions.

The manifold may extend long in an injection direction of the pulsed jets occurring in the plurality of orifices.

The manifold may include a plurality of inner passages that are connected to the plurality of orifices, respectively, and extend long, and a plurality of injection ports formed in a lengthwise direction of each of the inner passages so as to generate multi-pulsed jets.

The injection ports may be formed so that the pulsed jets of each inner passage are injected in different directions.

The injection ports may be formed so that the pulsed jets of each inner passage are injected in the same direction.

The injection ports may be formed so that the pulsed jets of each inner passage are obliquely injected with respect to a lengthwise direction of the inner passage.

The plurality of inner passages may be disposed to be spaced apart from each other.

The at least one actuator may include a housing in which the plurality of cavities are formed, and the at least one diaphragm may be mounted in the housing and partitions the plurality of cavities from each other.

The at least one diaphragm may include a first diaphragm and a second diaphragm, and the plurality of cavities may include a first cavity, a second cavity, and a third cavity, and the first cavity and the second cavity may be partitioned by the first diaphragm, and volumes of the first cavity and the second cavity may change by vibration of the first diaphragm, and the second cavity and the third cavity may be partitioned by the second diaphragm, and volumes of the second cavity and the third cavity may change by vibration of the second diaphragm.

In accordance with another aspect of the present invention, a multi-pulsed jets generating apparatus includes: at least one actuator including at least one diaphragm, a plurality of cavities partitioned by the at least one diaphragm and a plurality of orifices through which fluids in the plurality of cavities are introduced into/discharged from the plurality of cavities and generating pulsed jets according to vibration of the at least one diaphragm; and a manifold including a plurality of inner passages disposed to communicate with the plurality of cavities through the plurality of orifices, respectively, and a plurality of injection ports disposed to communicate with the plurality of inner passages and generating multi-pulsed jets according to vibration of the at least one diaphragm.

The plurality of cavities may include a first cavity and a second cavity, and the plurality of inner passages may include a first inner passage that communicates with the first cavity and a second inner passage that communicates with the second cavity.

The manifold may include a partitioning wall that partitions the first inner passage and the second inner passage.

The manifold may include first injection ports that communicate with the first inner passage and second injection ports that communicate with the second inner passage.

Pulsed jets occurring in the first injection ports and pulsed jets occurring in the second injection ports may have opposite phases.

The first injection ports and the second injection ports may be formed on different outer walls of the manifold.

An injection angle of the first injection ports and an injection angle of the second injection ports may be different from each other.

The at least one actuator may include a first actuator and a second actuator disposed on both ends of the manifold, respectively.

The first actuator and the second actuator may generate pulsed jets by operating in the same phase.

The first actuator and the second actuator may generate pulsed jets by operating in opposite phases.

The first actuator and the second actuator may generate pulsed jets in opposite directions.

In accordance with still another aspect of the present invention, an air conditioner includes: a cabinet having an inhalation port and a discharge port; at least one heat exchanger disposed in the cabinet; and at least one multi-pulsed jets generating apparatus including at least one actuator that generates pulsed jets in a plurality of orifices according to vibration of a diaphragm and a manifold connected to the at least one actuator so as to generate multi-pulsed jets by receiving the pulsed jets occurring in the plurality of orifices.

The at least one heat exchanger may have a straight shape.

The at least one heat exchanger may include a plurality of heat exchangers disposed in parallel, and the at least one multi-pulsed jets generating apparatus may be disposed between the plurality of heat exchangers.

The at least one actuator may include a first actuator and a second actuator disposed on both ends of the manifold, respectively.

The first actuator and the second actuator may generate pulsed jets by operating in the same phase.

The first actuator and the second actuator may generate pulsed jets by operating in opposite phases.

The first actuator and the second actuator may generate pulsed jets in opposite directions.

The at least one multi-pulsed jets generating apparatus may be disposed on top and bottom ends of the at least one heat exchanger.

The at least one multi-pulsed jets generating apparatus may include a plurality of manifolds.

The at least one heat exchanger may be disposed between the plurality of manifolds.

At least a part of pulsed jets occurring in the at least one multi-pulsed jets generating apparatus may be injected toward the at least one heat exchanger, and the remaining part of the pulsed jets may be injected toward the discharge port.

At least a part of pulsed jets occurring in the at least one multi-pulsed jets generating apparatus may be inclinedly injected toward the at least one heat exchanger.

In accordance with yet still another aspect of the present invention, an air conditioner includes: a cabinet having an inhalation port and a discharge port; at least one heat exchanger disposed in the cabinet; and a multi-pulsed jets generating apparatus including at least one actuator including at least one diaphragm, a plurality of cavities partitioned by the at least one diaphragm and a plurality of orifices through which fluids in the plurality of cavities are introduced into/discharged from the plurality of cavities and the at least one actuator generating pulsed jets according to vibration of the at least one diaphragm and a manifold having a plurality of inner passages disposed to communicate with the plurality of cavities, respectively, through the plurality of orifices and a plurality of injection ports disposed to communicate with the plurality of inner passages and generating multi-pulsed jets according to vibration of the at least one diaphragm.

The at least one actuator may include a first actuator and a second actuator disposed on both ends of the manifold, respectively.

Advantageous Effects

According to the spirit of the present invention, the direction and velocity of multi-pulsed jets can be set in various ways.

According to the spirit of the present invention, noise of an air conditioner can be reduced, and the air conditioner having a thin shape and a small size can be provided.

BEST MODE

The present invention will now be described more fully with reference to the accompanying drawings, in which exemplary embodiments of the invention are shown.

Figure 1:
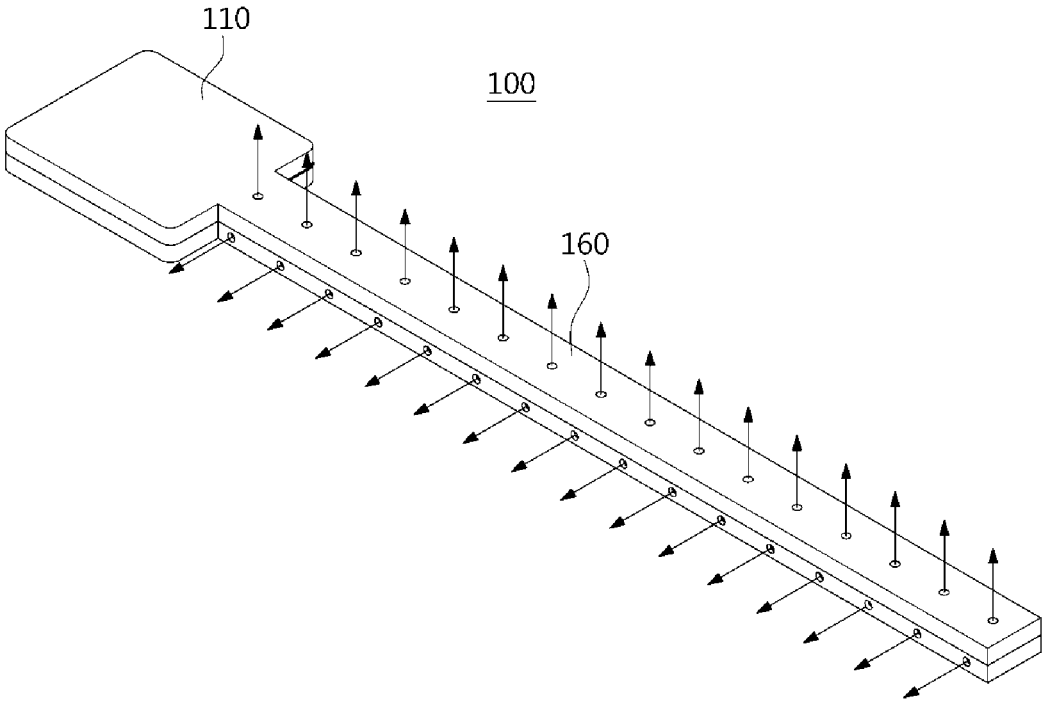
FIG. 1 is a perspective view of a multi-pulsed jets generating apparatus in accordance with a first embodiment of the present invention.
Figure 2:
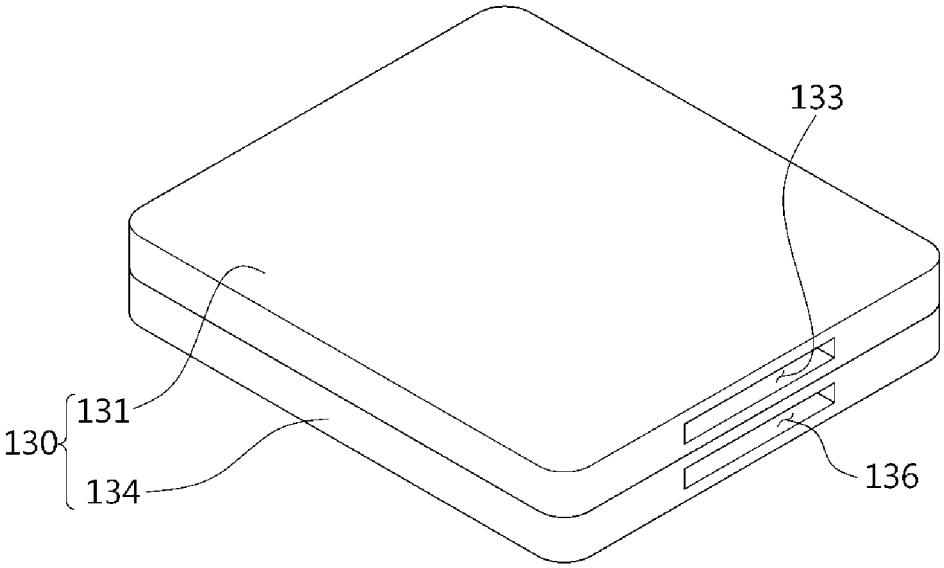
FIG. 2 is a perspective view of an actuator of the multi-pulsed jets generating apparatus in accordance with the first embodiment of the present invention.
Figure 3:
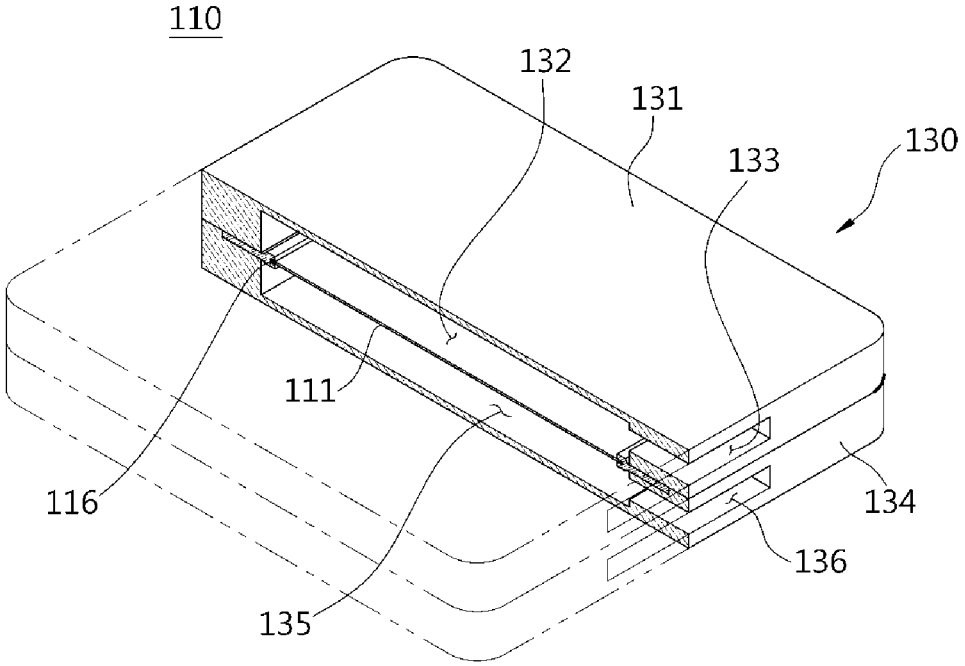
FIG. 3 is a perspective cross-sectional view of the actuator of the multi-pulsed jets generating apparatus in accordance with the first embodiment of the present invention.

FIG. 1 is a perspective view of a multi-pulsed jets generating apparatus in accordance with a first embodiment of the present invention, and FIG. 2 is a perspective view of an actuator of the multi-pulsed jets generating apparatus in accordance with the first embodiment of the present invention, and FIG. 3 is a perspective cross-sectional view of the actuator of the multi-pulsed jets generating apparatus in accordance with the first embodiment of the present invention.

Referring to FIGS. 1 through 3, a multi-pulsed jets generating apparatus 100 includes an actuator 110 that generates pulsed jets using vibration of a diaphragm 111 and a manifold 160 that generates multi-pulsed jets in a large region by receiving the pulsed jets generated by the actuator 110.

The actuator 110 includes a housing 130, the diaphragm 111 mounted in the housing 130, a first cavity 132 and a second cavity 135 that are formed in the housing 130 and partitioned by the diaphragm 111, a first orifice 133 through which the first cavity 132 communicates with the outside, and a second orifice 136 through which the second cavity 135 communicates with the outside. A fluid, such as air, may be accommodated in the first cavity 132 and the second cavity 135.

In the present embodiment, one first orifice 133 and one second orifice 136 are disposed, but two or more first orifices 133 and two or more second orifices 136 may be disposed.

The actuator 110 may have an approximately thin rectangular parallelepiped shape. However, the shape of the actuator 110 is not limited. The housing 130 may constitute the exterior of the actuator 110 and may define the first cavity 132 and the second cavity 135.

The housing 130 may be formed by combining a first housing 131 having the first cavity 132 and the first orifice 133 and a second housing 134 having the second cavity 135 and the second orifice 136. However, unlike this, the housing 130 may be formed as a single body.

The diaphragm 111 may be mounted between the first housing 131 and the second housing 134 using a fixing member 116. The fixing member 116 may be disposed at an edge of the diaphragm 111.

The diaphragm 111 may have flexibility and may be deformed. The diaphragm 111 may vibrate in a predetermined period. The diaphragm 111 may be deformed to be convex toward the first cavity 132 or the second cavity 135 in the predetermined period. The diaphragm 111 may be deformed due to a piezoelectric effect.

That is, the diaphragm 111 may include a plurality of piezoelectric elements stacked in mutual reverse polarization directions. When power is applied to the plurality of piezoelectric elements, one piezoelectric element elongates, and the other one piezoelectric element is compressed so that the diaphragm 111 may be deformed to be convex in one direction. As the size of the power applied to the piezoelectric elements is increased, larger deformation may occur in the diaphragm 111.

When an electric potential of the power applied to the piezoelectric elements is inverted, a deformation direction of the diaphragm 111 may be inverted. Thus, the diaphragm 111 may vibrate due to a periodic change of the power applied to the piezoelectric elements. Sheets formed of an elastic material may be disposed between the piezoelectric elements.

The actuator 110 may further include a power generator (not shown) that generates the power applied to the piezoelectric elements and a controller (not shown) that controls applying of the power to the piezoelectric elements by receiving input signals.

Figure 4:
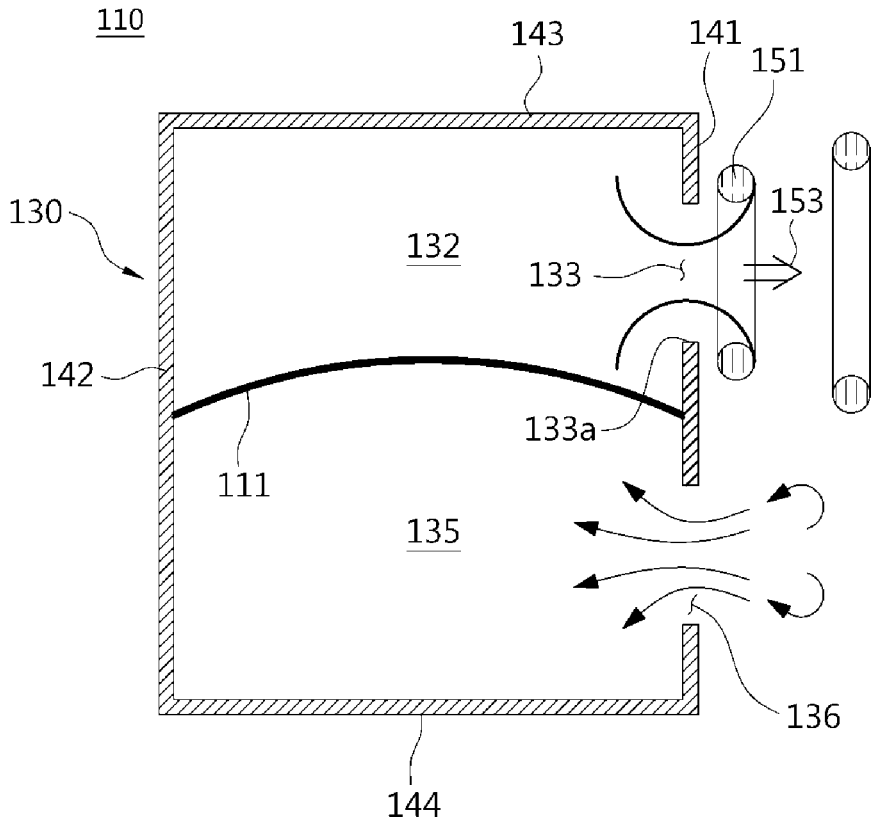
FIGS. 4 and 5 are views of an operation of the actuator of the multi-pulsed jets generating apparatus in accordance with the first embodiment of the present invention.
Figure 5:
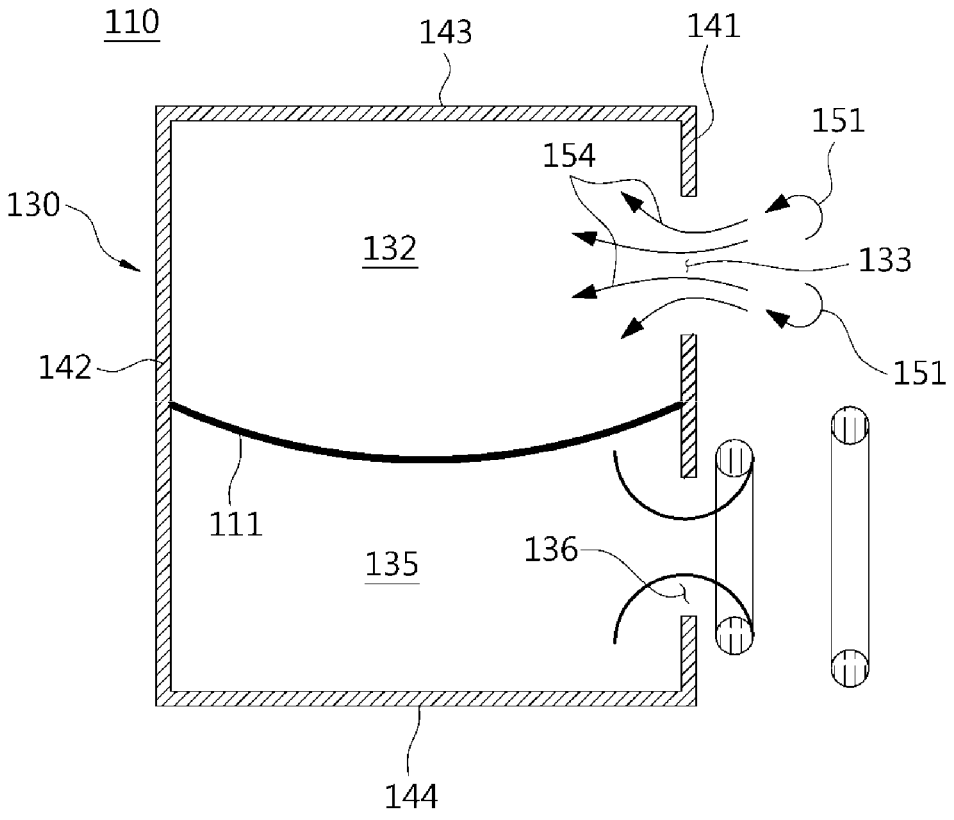

FIGS. 4 and 5 are views of an operation of the actuator of the multi-pulsed jets generating apparatus in accordance with the first embodiment of the present invention.

The housing 130 of the actuator 110 may include a first wall 141, a second wall 142 that faces the first wall 141, and a third wall 143 and a fourth wall 144 that connect the first wall 141 and the second wall 142 and face each other.

The diaphragm 111 may be disposed so that its both ends may be in contact with the first wall 141 and the second wall 142.

Thus, the first cavity 132 may be defined and surround by the first wall 141, the second wall 142, the third wall 143, and the diaphragm 111. The second cavity 135 may be defined and surrounded by the first wall 141, the second wall 142, the fourth wall 144, and the diaphragm 111.

The first orifice 133 through which the first cavity 132 communicates with the outside and the second orifice 136 through which the second cavity 135 communicates with the outside, may be formed in the first wall 141. Thus, pulsed jets may be injected through the first orifice 133 and the second orifice 136 in approximately the same direction.

The diaphragm 111 may be deformed to be convex toward the first cavity 132 or the second cavity 135. The diaphragm 111 may vibrate in a predetermined period. When the diaphragm 111 vibrates, pulsed jets may be generated in both sides of the diaphragm 111, respectively, and two pulsed jets may have opposite phases.

As illustrated in FIG. 4, when the diaphragm 111 is deformed to be convex toward the first cavity 132, the volume of the first cavity 132 may be decreased, and the pressure thereof may be increased. Thus, a fluid in the first cavity 132 may be discharged to the outside through the first orifice 133 until the pressure of the first cavity 132 is the same as an external pressure.

When the fluid in the first cavity 132 is discharged to the outside through the first orifice 133, a flow is separated from an edge 133*a* of the first orifice 133, forms a vortex 151 and is far away from the first orifice 133 in a direction of arrow 153.

The flow may occur periodically according to vibration of the diaphragm 111. Thus, a periodic flow injected from the first orifice 133 in the direction of arrow 153 according to vibration of the diaphragm 111 may be referred to as pulsed jets.

As illustrated in FIG. 5, when the diaphragm 111 is deformed to be convex toward the second cavity 135, the volume of the first cavity 132 may be increased, and the pressure thereof may be decreased. Thus, an external fluid may be introduced into the first cavity 132 through the first orifice 133 until the pressure of the first cavity 132 is the same as the external pressure (154).

When the external fluid is introduced into the first cavity 132 through the first orifice 133, the above-described vortex 151 has been already separated from the first orifice 133 and thus, this may not disturb introduction of the external fluid.

A procedure in which pulsed jets occur in the second orifice 136 due to vibration of the diaphragm 111, is the same as a procedure in which pulsed jets occur in the first orifice 133. Thus, a description thereof will be omitted.

Amounts of the fluid introduced into and discharged from the first cavity 132 through the first orifice 133 during a first vibration period of the diaphragm 111 are the same. Amounts of the fluid introduced into and discharged from the second cavity 135 through the second orifice 136 during the first vibration period of the diaphragm 111 are the same.

The pulsed jets that occur in the first orifice 133 and the pulsed jets that occur in the second orifice 136 may have opposite phases. This is because the volume of the first cavity 132 and the volume of the second cavity 135 are alternately increased or decreased according to vibration of the diaphragm 111. That is, when the volume of the first cavity 132 is increased, the volume of the second cavity 135 is decreased, and when the volume of the first cavity 132 is decreased, the volume of the second cavity 135 is increased. The volume of the first cavity 132 and the volume of the second cavity 135 are dependent on each other.

When it is set that a volume change amount of the first cavity 132 and a volume change amount of the second cavity 135 are the same, the pulsed jets that occur in the first orifice 133 and the pulsed jets that occur in the second orifice 136 have opposite phases but may have the same velocity.

Figure 6:
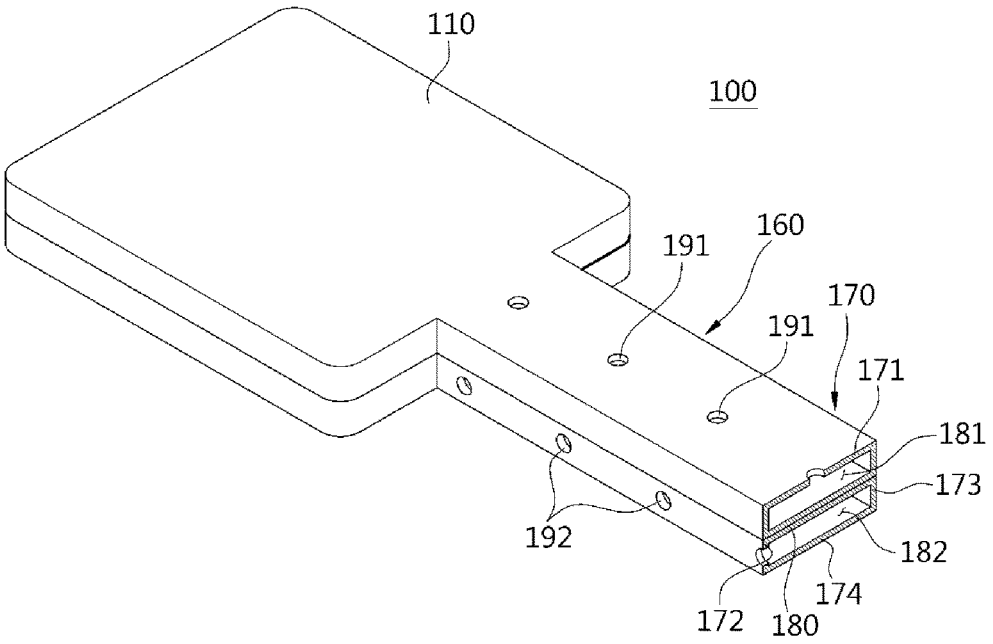
FIG. 6 is a cross-sectional view of a structure of a manifold of the multi-pulsed jets generating apparatus in accordance with the first embodiment of the present invention.

FIG. 6 is a cross-sectional view of a structure of a manifold of the multi-pulsed jets generating apparatus in accordance with the first embodiment of the present invention.

As illustrated in FIG. 6, the multi-pulsed jets generating apparatus 100 includes the manifold 160 that generates multi-pulsed jets in a large region by receiving pulsed jets occurring in the actuator 110. Here, the range of the large region is not limited and may be approximately the range that covers the size of a heat exchanger of an air conditioner that will be described later.

The manifold 160 may have a shape of a stick having an approximately rectangular cross section but the shape of the manifold 160 is not limited thereto. The cross section of the manifold 160 may have various shapes, a circular shape, an oval shape, and a triangular shape, in addition to the rectangular shape. The manifold 160 need not to have a rectilinear shape. The manifold 160 may also have a bent shape as necessary.

The manifold 160 may extend long in an injection direction of the pulsed jets injected through the orifices 133 and 136 of the actuator 110.

The manifold 160 may include an outer wall portion 170, a first inner passage 181 and a second inner passage 182 that are formed in the outer wall portion 170, a partitioning wall 180 that partitions the first inner passage 181 and the second inner passage 182, a plurality of first injection ports 191 that communicate with the first inner passage 181, and a plurality of second injection ports 192 that communicate with the second inner passage 182. The outer wall portion 170 may include an upper wall 171, sidewalls 172 and 173, and a bottom wall 174.

The first inner passage 181 is disposed to communicate with the first cavity 132 of the actuator 110 through the first orifice 133 of the actuator 110. The first inner passage 181 is a closed space except for the first orifice 133 and the first injection ports 191.

Thus, a pressure change of the first cavity 132 that occurs when the diaphragm 111 vibrates may be intactly transmitted to the first inner passage 181, and a pressure change of the first inner passage 181 may cause pulsed jets in each of the first injection ports 191. The pulsed jets occurring in the first injection ports 191 may have the same phase.

The arrangement of the first injection ports 191 is not limited, but the first injection ports 191 may be arranged in one or more rows in a lengthwise direction of the manifold 160. The first injection ports 191 may be disposed to be spaced a predetermined distance apart from each other.

The second inner passage 182 is disposed to communicate with the second cavity 135 of the actuator 110 through the second orifice 136 of the actuator 110. The second inner passage 182 is a closed space except for the second orifice 136 and the second injection ports 192.

Thus, a pressure change of the second cavity 135 that occurs when the diaphragm 111 vibrates may be intactly transmitted to the second inner passage 182, and a pressure change of the second inner passage 182 may cause pulsed jets in each of the second injection ports 192. The pulsed jets occurring in the second injection ports 192 may have the same phase.

The arrangement of the second injection ports 192 is not limited, but the second injection ports 192 may be arranged in one or more rows in the lengthwise direction of the manifold 160. The second injection ports 192 may be disposed to be spaced a predetermined distance apart from each other.

Through this configuration, the multi-pulsed jets generating apparatus 100 in accordance with the first embodiment of the present invention may generate the multi-pulsed jets in the large region.

When phases of the pulsed jets occurring in the first orifice 133 and the second orifice 136 of the actuator 110 are opposite to each other, the phases of the pulsed jets occurring in the first injection ports 191 and the second injection ports 192 may also be opposite to each other.

In this case, when the first injection ports 191 and the second injection ports 192 are disposed to be adjacent to each other, flows having opposite phases may lower flow velocity. Thus, the first injection ports 191 and the second injection ports 192 may be disposed to be spaced apart from each other or to have different injection angles.

For example, as illustrated in FIG. 1, the first injection ports 191 may be disposed to inject pulsed jets upward from the upper wall 171 of the manifold 160, and the second injection ports 192 may be disposed to inject pulsed jets forward from one sidewall 172 of the manifold 160.

In the present embodiment, the injection angles of the first injection ports 191 and the second injection ports 192 are perpendicular to each other but are not limited thereto and may be set in various ways in a range in which mutual interference between the pulsed jets may be avoided.

Directions of the pulsed jets injected from the manifold 160 may be set in various ways, which may be more advantageous in designing the air conditioner having a small size and a thin shape.

Figure 7:
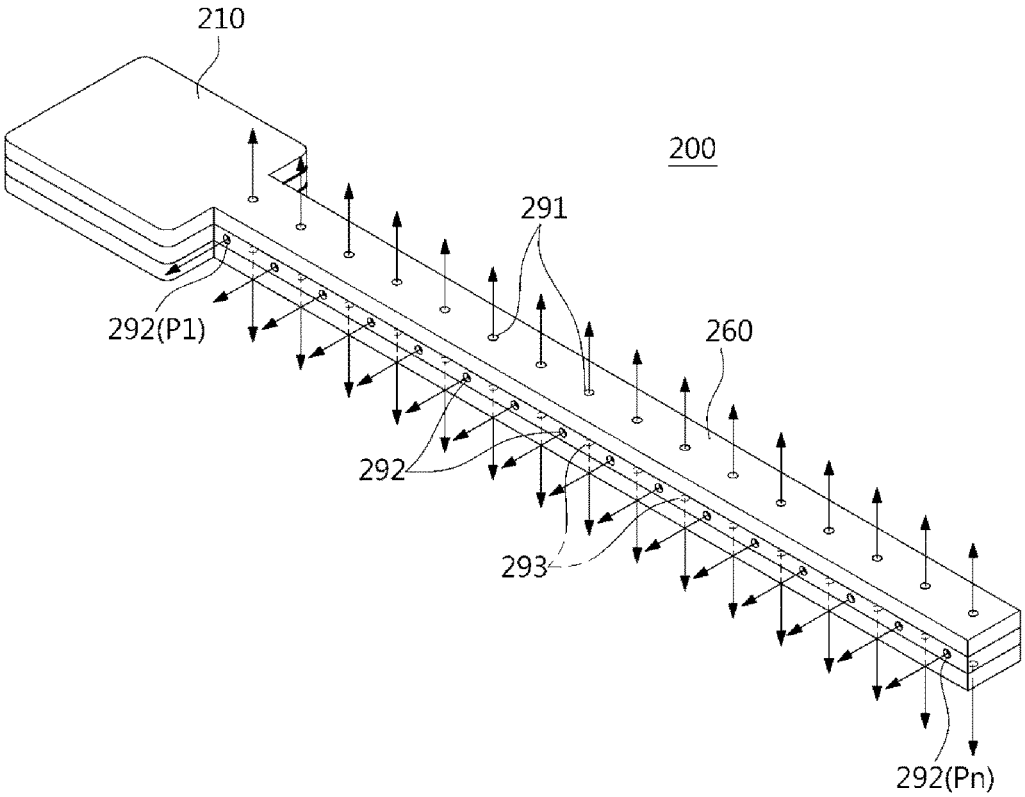
FIG. 7 is a perspective view of a multi-pulsed jets generating apparatus in accordance with a second embodiment of the present invention.
Figure 8:
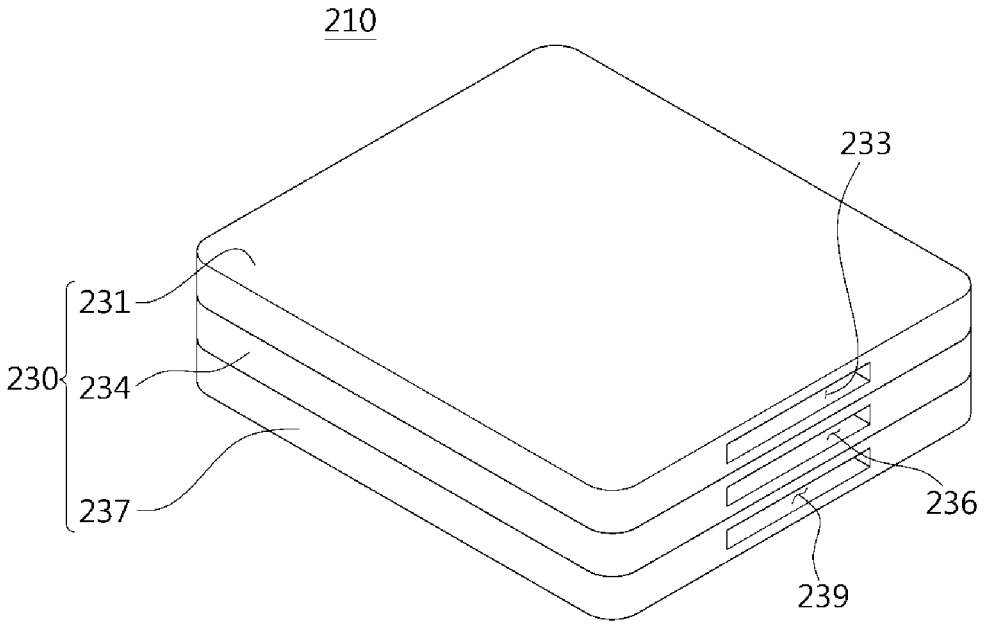
FIG. 8 is a perspective view of an actuator of the multi-pulsed jets generating apparatus in accordance with the second embodiment of the present invention.
Figure 9:
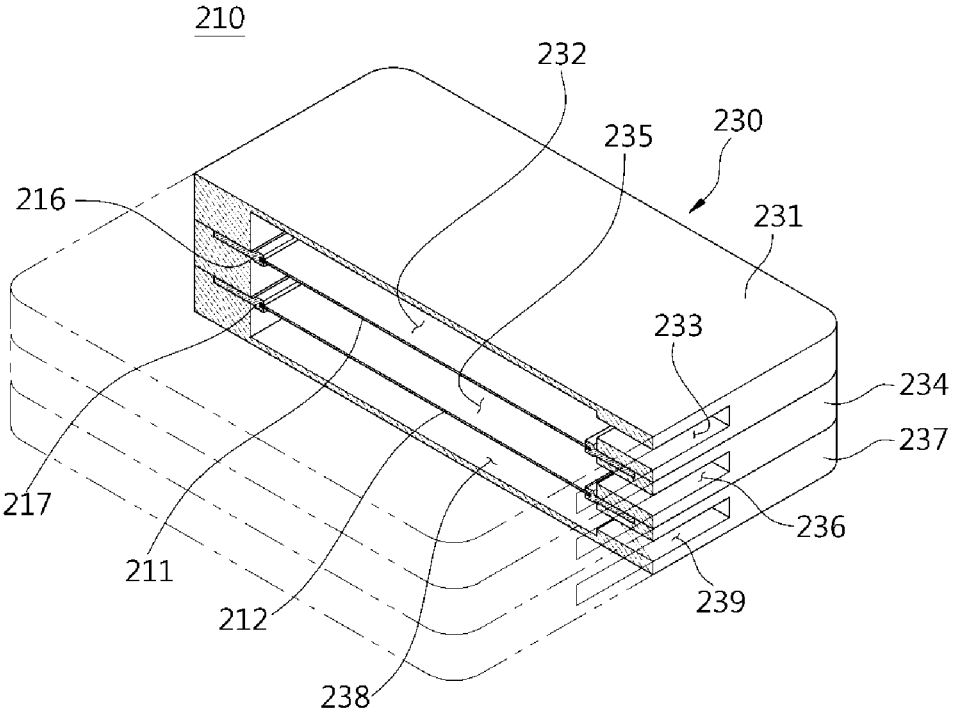
FIG. 9 is a perspective cross-sectional view of the actuator of the multi-pulsed jets generating apparatus in accordance with the second embodiment of the present invention.
Figure 10:
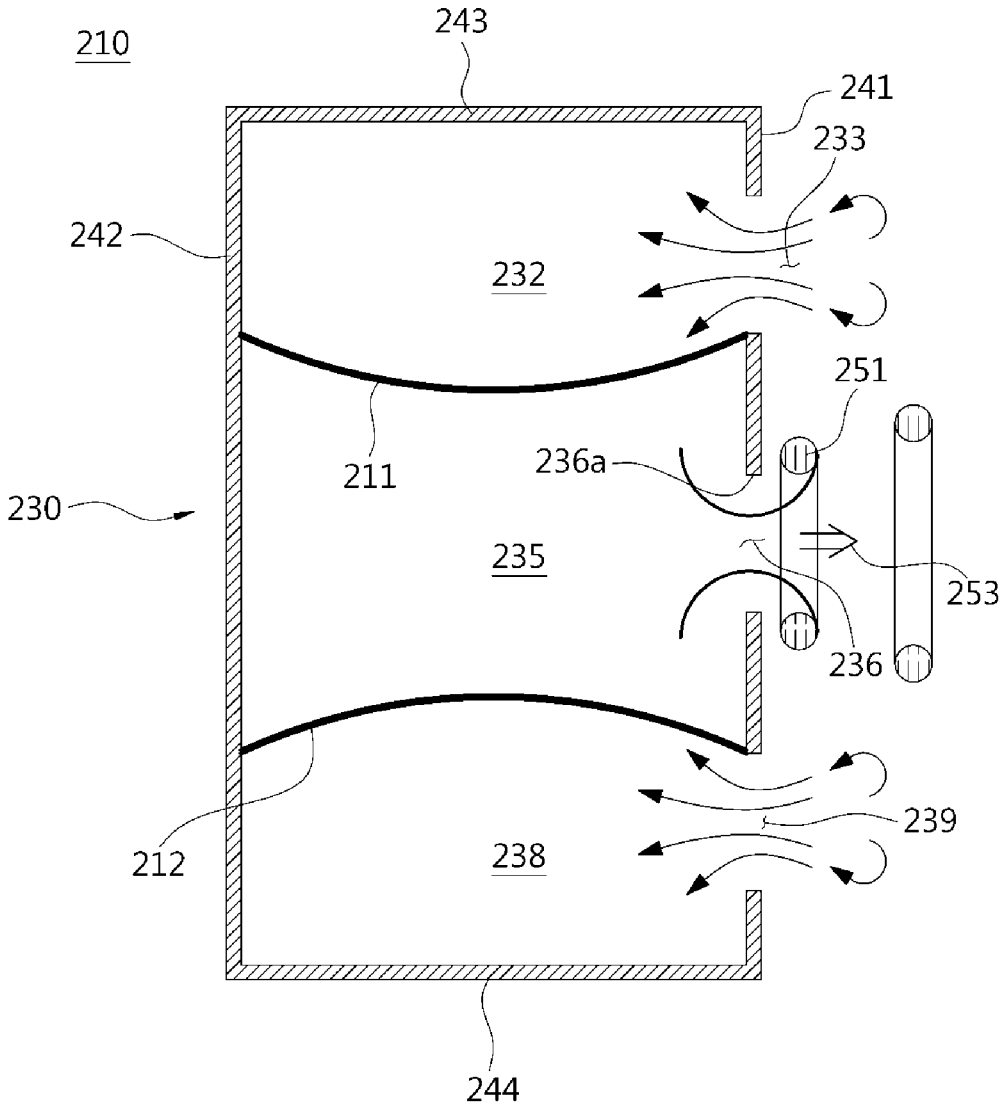
FIGS. 10 and 11 are views of an operation of the actuator of the multi-pulsed jets generating apparatus in accordance with the second embodiment of the present invention.
Figure 11:
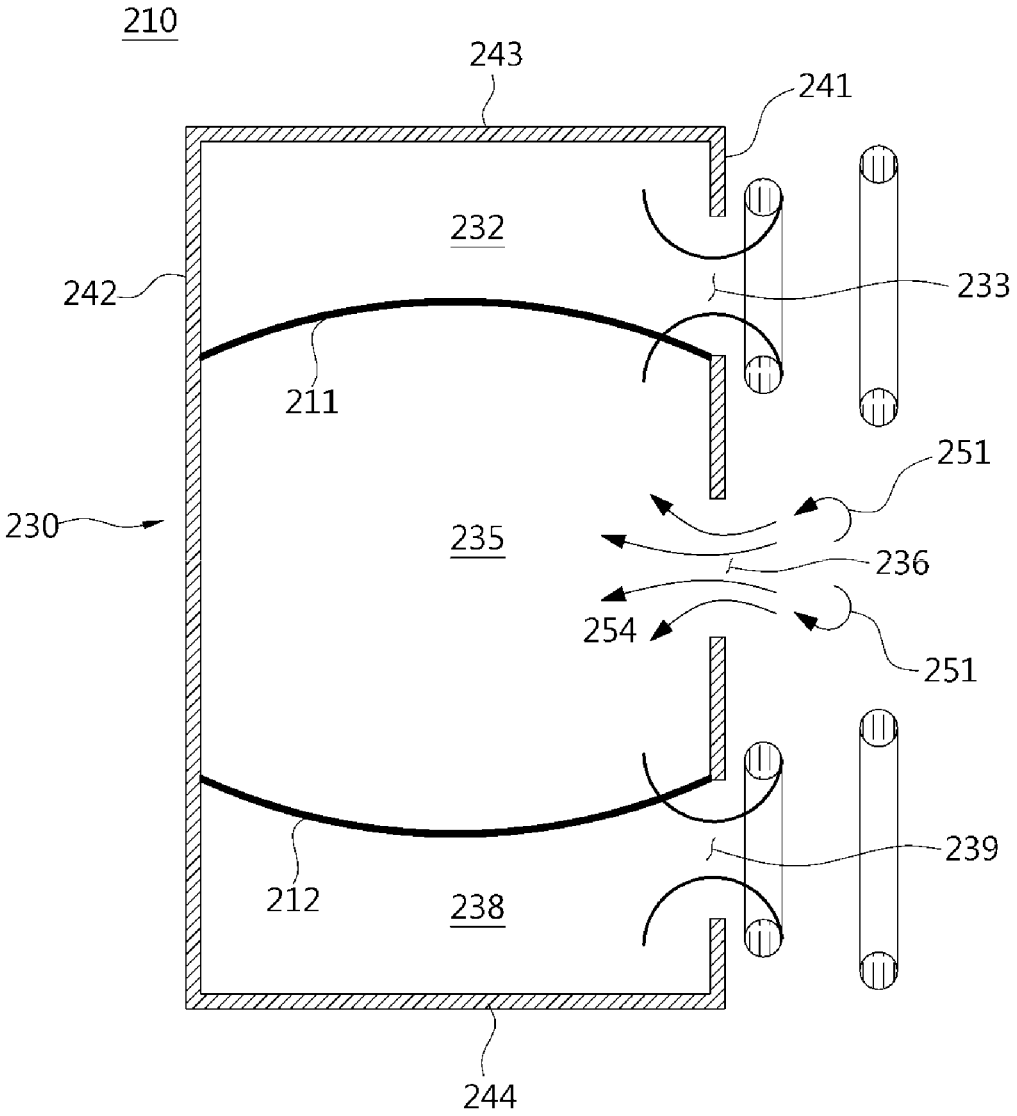

FIG. 7 is a perspective view of a multi-pulsed jets generating apparatus in accordance with a second embodiment of the present invention, and FIG. 8 is a perspective view of an actuator of the multi-pulsed jets generating apparatus in accordance with the second embodiment of the present invention, and FIG. 9 is a perspective cross-sectional view of the actuator of the multi-pulsed jets generating apparatus in accordance with the second embodiment of the present invention, and FIGS. 10 and 11 are views of an operation of the actuator of the multi-pulsed jets generating apparatus in accordance with the second embodiment of the present invention.

A multi-pulsed jets generating apparatus 200 in accordance with a second embodiment of the present invention will be described with reference to FIGS. 7 through 11. A description of the same configuration of the second embodiment as that of the first embodiment may be omitted.

In the first embodiment of the present invention, the actuator 110 generates two pulsed jets in both sides of the diaphragm 111 by using one diaphragm 111. However, in the second embodiment of the present invention, the actuator 210 may include two diaphragms 211 and 212 and may generate three pulsed jets.

Although a separate description thereof is not provided, the number of diaphragms of the actuators 210 is not limited thereto, and the actuator 210 may include more diaphragms and may generate more pulsed jets.

The actuator 210 includes a housing 230, a first cavity 232, a second cavity 235 and a third cavity 238 that are formed in the housing 230, a first diaphragm 211 and a second diaphragm 212 that partition the cavities 232, 235 and 238, a first orifice 233 formed in the housing 230 so that the first cavity 232 may communicate with the outside through the first orifice 233, a second orifice 236 formed in the housing 230 so that the second cavity 235 may communicate with the outside through the second orifice 236, and a third orifice 239 formed in the housing 230 so that the third cavity 238 may communicate with the outside through the third orifice 239.

The housing 230 may be formed by combining a first housing 231 having the first cavity 232 and the first orifice 233, a second housing 234 having the second cavity 235 and a second orifice 236, and a third housing 237 having a third cavity 238 and a third orifice 239. However, formation of the housing 230 is not limited thereto, and the housing 230 may be formed as a single body.

The first diaphragm 211 may be mounted between the first housing 231 and the second housing 234 by using a first fixing member 216. The first fixing member 216 may be disposed at an edge of the first diaphragm 211.

The second diaphragm 212 may be mounted between the second housing 234 and the third housing 237 using a second fixing member 217. The second fixing member 217 may be disposed at an edge of the second diaphragm 212.

The first diaphragm 211 and the second diaphragm 212 may vibrate in a predetermined period. The first diaphragm 211 may be deformed to be convex toward the first cavity 232 or the second cavity 235 in the predetermined period. The second diaphragm 212 may be deformed to be convex toward the second cavity 235 or the third cavity 238 in the predetermined period.

Periods of the first diaphragm 211 and the second diaphragm 212 may be the same. Amplitudes of the first diaphragm 211 and the second diaphragm 212 may be the same.

The first diaphragm 211 and the second diaphragm 212 may be deformed in opposite directions. That is, the first diaphragm 211 and the second diaphragm 212 may vibrate in opposite phases. That is, when the first diaphragm 211 is deformed to be convex toward the first cavity 232, the second diaphragm 212 may be deformed to be convex toward the third cavity 238, and when the first diaphragm 211 is deformed to be convex toward the second cavity 235, the second diaphragm 212 may be deformed to be convex toward the second cavity 235.

The shape of the housing 230 is not limited. For example, the housing 230 may include a first wall 241, a second wall 242 that faces the first wall 241, and a third wall 243 and a fourth wall 244 that connect the first wall 241 and the second wall 242 and face each other.

The first diaphragm 211 and the second diaphragm 212 may be disposed so that their both ends may be in contact with the first wall 241 and the second wall 242.

Thus, the first cavity 232 may be defined and surrounded by the first wall 241, the second wall 242, the third wall 243, and the first diaphragm 211. The second cavity 235 may be defined and surrounded by the first wall 241, the second wall 242, the first diaphragm 211, and the second diaphragm 212. The third cavity 238 may be defined and surrounded by the first wall 241, the second wall 242, the fourth wall 244, and the second diaphragm 212.

The first orifice 233 through which the first cavity 232 communicates with the outside, the second orifice 236 through which the second cavity 235 communicates with the outside, and the third orifice 239 through which the third cavity 238 communicates with the outside, may be formed in the first wall 241. Thus, pulsed jets may be injected through the first orifice 233, the second orifice 236 and the third orifice 239 in an approximately the same direction.

As illustrated in FIG. 10, when the first diaphragm 211 is deformed to be convex toward the second cavity 235 and the second diaphragm 212 is deformed to be convex toward the second cavity 235, the volume of the second cavity 235 may be decreased, and the pressure thereof may be increased. Thus, a fluid in the second cavity 235 may be discharged to the outside through the second orifice 236 until the pressure of the second cavity 235 is the same as an external pressure.

When the fluid in the second cavity 235 is discharged to the outside through the second orifice 236, a flow is separated from an edge 236*a* of the second orifice 236, forms a vortex 251 and is far away from the second orifice 236 in a direction of arrow 253.

The flow may occur periodically according to periodic vibration of the first diaphragm 211 and the second diaphragm 212. Thus, a periodic flow injected from the second orifice 236 in the direction of arrow 253 according to periodic vibration of the first diaphragm 211 and the second diaphragm 212 may be referred to as pulsed jets.

As illustrated in FIG. 11, when the first diaphragm 211 is deformed to be convex toward the first cavity 232 and the second diaphragm 212 is deformed to be convex toward the third cavity 238, the volume of the second cavity 235 may be increased, and the pressure thereof may be decreased. Thus, the external fluid may be introduced into the second cavity 235 through the second orifice 236 until the pressure of the second cavity 235 is the same as the external pressure (254).

When the external fluid is introduced into the second cavity 235 through the second orifice 236, the above-described vortex 251 has been already separated from the second orifice 236 and thus this may not disturb introduction of the external fluid.

A procedure, in which pulsed jets occur in the first orifice 233 due to vibration of the diaphragms 211 and 212, is the same as a procedure in which pulsed jets occur in the third orifice 239. Thus, a description thereof will be omitted.

Amounts of the fluid introduced into and discharged from the cavities 232, 235 and 238 through the orifices 233, 236 and 239 during a first vibration period of the diaphragms 211 and 212 are the same.

The pulsed jets that occur in the first orifice 233 and the pulsed jets that occur in the third orifice 239 may have the same phase. Also, a phase of the pulsed jets occurring in the second orifice 236 may be opposite to a phase of the pulsed jets occurring in the third orifice 239.

Figure 12:
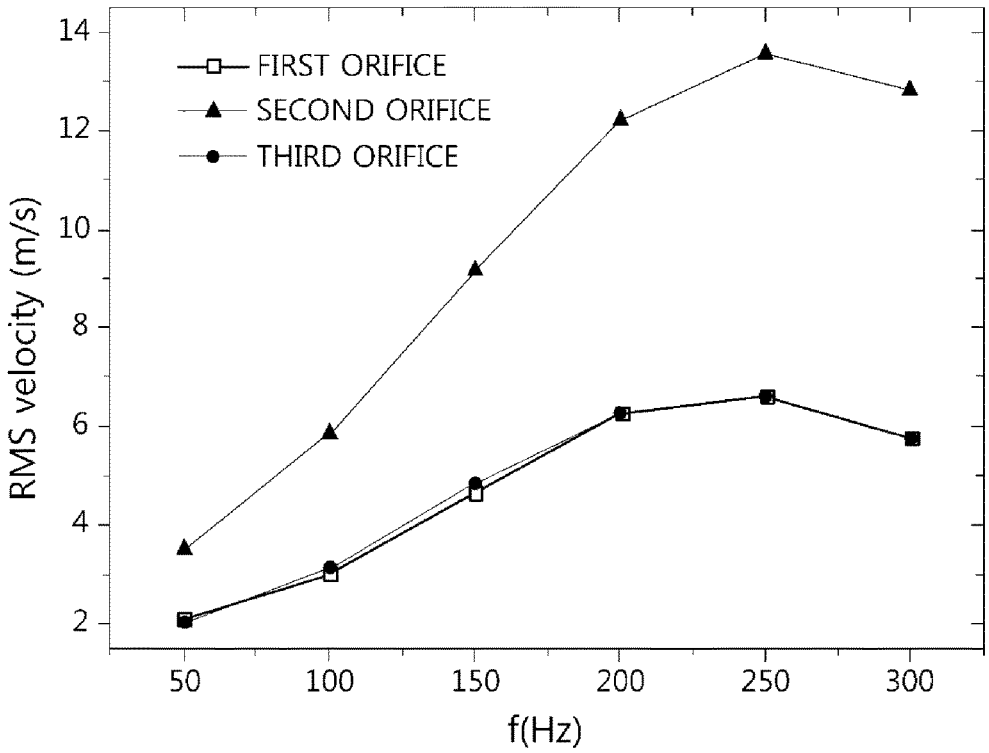
FIG. 12 is a view for comparing velocity of pulsed jets of first injection ports, second injection ports and third injection ports of the multi-pulsed jets generating apparatus in accordance with the second embodiment of the present invention.

FIG. 12 is a view for comparing velocity of pulsed jets of first injection ports, second injection ports and third injection ports of the multi-pulsed jets generating apparatus in accordance with the second embodiment of the present invention. In FIG. 12, a horizontal axis represents frequencies of the diaphragms 211 and 212, and a vertical axis represents RMS velocity of the pulsed jets occurring in the orifices 233, 236, and 239.

As illustrated in FIG. 12, as the frequencies of the diaphragms 211 and 212 are increased, the velocity of the pulsed jets occurring in the orifices 233, 236, and 239 may be usually increased.

Also, the velocity of the pulsed jets occurring in the first orifice 233 and the third orifice 239 may be approximately the same in all frequencies.

Also, the velocity of the pulsed jets occurring in the second orifice 236 may be larger than the velocity of the pulsed jets occurring in the first orifice 233 and the third orifice 239 in all frequencies. This is because a volume change of the first cavity 232 is affected by only vibration of the first diaphragm 211, a volume change of the third cavity 238 is affected by only vibration of the second diaphragm 212 and a volume change of the second cavity 235 is affected by both vibration of the first diaphragm 211 and vibration of the second diaphragm 212.

However, these results are obtained by assuming that the first diaphragm 211 and the second diaphragm 212 vibrate in the same period, the same amplitude and opposite phases. Of course, these results may be different when vibration periods, amplitudes or phases of the first diaphragm 211 and the second diaphragm 212 are different from each other.

Figure 13:
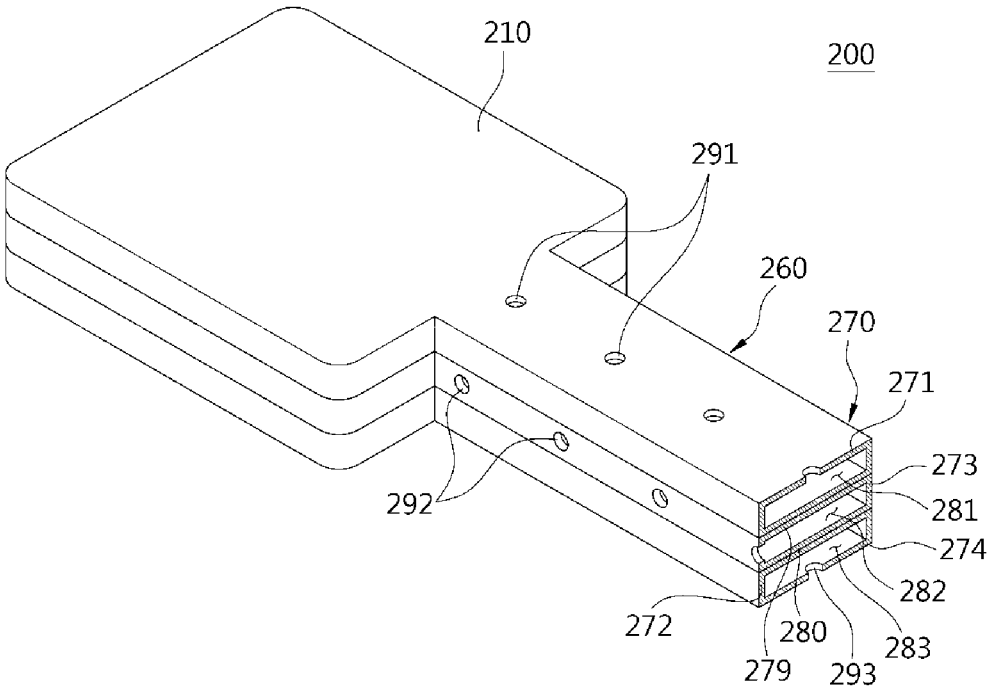
FIG. 13 is a cross-sectional view of a structure of a manifold of the multi-pulsed jets generating apparatus in accordance with the second embodiment of the present invention.

FIG. 13 is a cross-sectional view of a structure of a manifold of the multi-pulsed jets generating apparatus in accordance with the second embodiment of the present invention.

As illustrated in FIG. 13, the multi-pulsed jets generating apparatus 200 in accordance with the second embodiment of the present invention includes a manifold 260 that generates multi-pulsed jets in a large region by receiving the pulsed jets occurring in the actuator 210.

The manifold 260 may include an outer wall portion 270, a first inner passage 281, a second inner passage 282 and a third inner passage 283 that are formed in the outer wall portion 270, partitioning walls 279 and 280 that partition the inner passages 281, 282 and 283, a plurality of first injection ports 291 that communicate with the first inner passage 281, and a plurality of third injection ports 293 that communicate with the third inner passage 283. The outer wall portion 270 may include the upper wall 271, sidewalls 272 and 273, and a bottom wall 274.

The inner passages 281, 282, and 283 are disposed to communicate with the cavities 232, 235, and 238 of the actuator 210 through the orifices 233, 236, and 239 of the actuator 210. The inner passages 281, 282, and 283 are closed spaces except for the orifices 233, 236, and 239 and the injection ports 291, 292, and 293.

Thus, pressure changes of the cavities 232, 235, and 238 that occur when the diaphragms 211 and 212 vibrate may be intactly transmitted to the inner passages 281, 282, and 283. The pressure changes of the inner passages 281, 282, and 283 may cause pulsed jets in each of the injection ports 291, 292, and 293. The pulsed jets occurring in the first injection ports 191 may have the same phase. The pulsed jets occurring in the second injection ports 292 may have the same phase. The pulsed jets occurring in the third injection ports 293 may have the same phase.

When a phase of the pulsed jets occurring in the first orifice 233 of the actuator 210 and a phase of the pulsed jets occurring in the third orifice 239 of the actuator 210 are the same, phases of the pulsed jets occurring in the first injection ports 291 and the third injection ports 293 may also be the same.

When a phase of the pulsed jets occurring in the second orifice 236 of the actuator 210 is opposite to the phases of the pulsed jets occurring in the first orifice 233 and the third orifice 239, the phase of the pulsed jets occurring in the second injection ports 292 may be opposite to the phases of the pulsed jets occurring in the first injection ports 291 and the third injection ports 293.

The injection ports 291, 292, and 293 may be disposed not to be adjacent to each other and may have different injection angles so that flows having opposite phases may be prevented from causing lowering of flow velocity.

The first injection ports 291 may be disposed to inject the pulsed jets upward from the upper wall 271 of the manifold 260, and the second injection ports 292 may be disposed to inject the pulsed jets forward from one sidewall 272 of the manifold 260, and the third injection ports 293 may be disposed to inject the pulsed jets downward from the bottom wall 274 of the manifold 260.

The injection angles of the injection ports 291, 292, and 293 may be set in various ways in a range in which mutual interference between the pulsed jets may be avoided, and are not limited.

Figure 14:
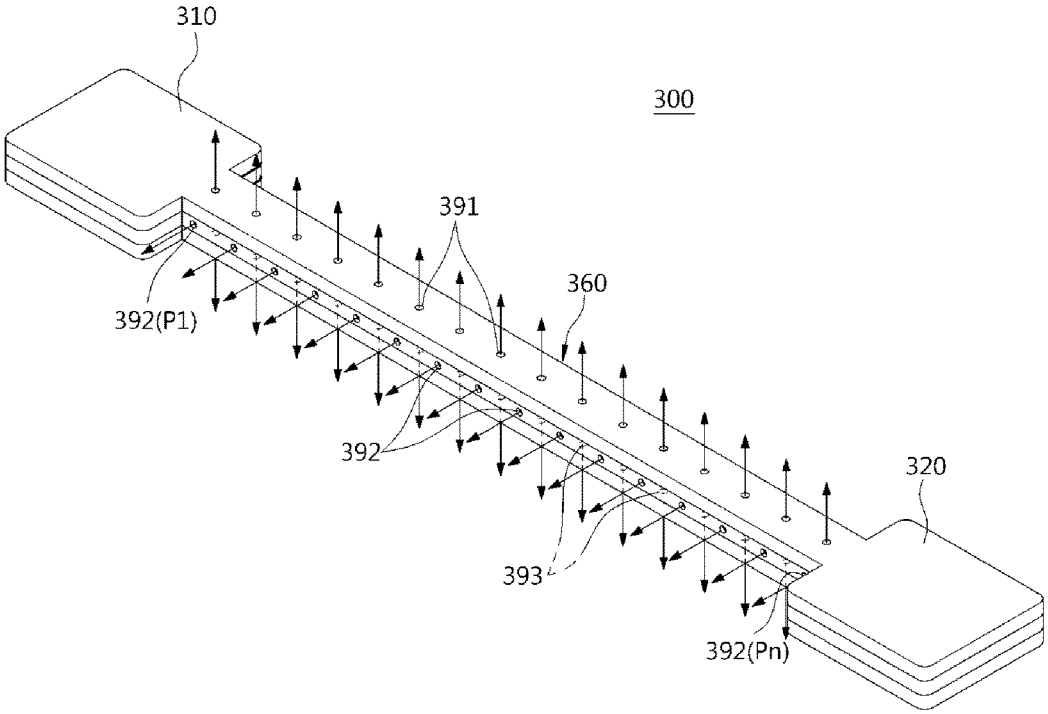
FIG. 14 is a perspective view of a multi-pulsed jets generating apparatus in accordance with a third embodiment of the present invention.
Figure 15:
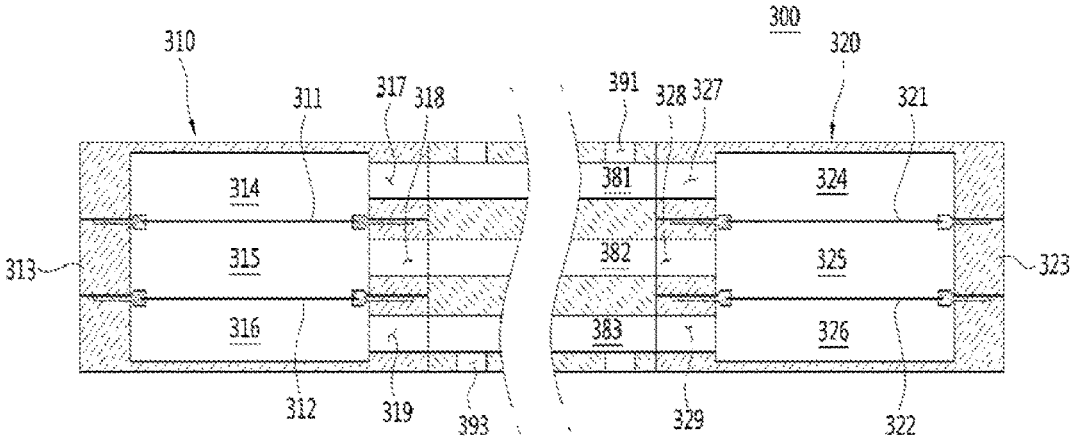
FIG. 15 is a schematic cross-sectional view of the entire configuration of the multi-pulsed jets generating apparatus in accordance with the third embodiment of the present invention.

FIG. 14 is a perspective view of a multi-pulsed jets generating apparatus in accordance with a third embodiment of the present invention, and FIG. 15 is a schematic cross-sectional view of the entire configuration of the multi-pulsed jets generating apparatus in accordance with the third embodiment of the present invention.

A multi-pulsed jets generating apparatus in accordance with a third embodiment of the present invention will be described with reference to FIGS. 14 and 15. A description of a redundant configuration with those of the first and second embodiments may be omitted.

A multi-pulsed jets generating apparatus 300 includes a plurality of actuators 310 and 320 that generate pulsed jets using vibration of diaphragms, and a manifold 360 that generates multi-pulsed jets in a large region by receiving the pulsed jets occurring in the plurality of actuators 310 and 320.

The plurality of actuators 310 and 320 may be disposed on both ends of a lengthwise direction of the manifold 360. The plurality of actuators 310 and 320 may be disposed to inject the pulsed jets in opposite directions.

The plurality of actuators 310 and 320 may include a first actuator 310 disposed on an end of the lengthwise direction of the manifold 360 and a second actuator 320 disposed on the other end of the lengthwise direction of the manifold 360.

The actuators 310 and 320 include housings 313 and 323, cavities 314, 315, 316, 324, 325, and 326 formed in the housings 313 and 323, diaphragms 311, 312, 321, and 322 that partition the cavities 314, 315, 316, 324, 325, and 326, and orifices 317, 318, 319, 327, 328, and 329 formed in the housings 313 and 323 so that the cavities 314, 315, 316, 324, 325, and 326 and the outside may communicate with each other through the orifices 317, 318, 319, 327, 328, and 329.

The diaphragms 311, 312, 321, and 322 may vibrate in a predetermined period. The diaphragms 311, 312, 321, and 322 may vibrate in the same period and the same amplitude.

The first diaphragm 311 and the second diaphragm 312 of the first actuator 310 may vibrate in opposite phases. The third diaphragm 321 and the fourth diaphragm 322 of the second actuator 320 may vibrate in opposite phases. Here, the opposite phases mean that a phase difference is $\pi$ (180°).

Also, corresponding diaphragms among the diaphragms 311 and 312 of the first actuator 310 and the diaphragms 321 and 322 of the second actuator 320 may vibrate in the same phase or opposite phases.

Figure 17:
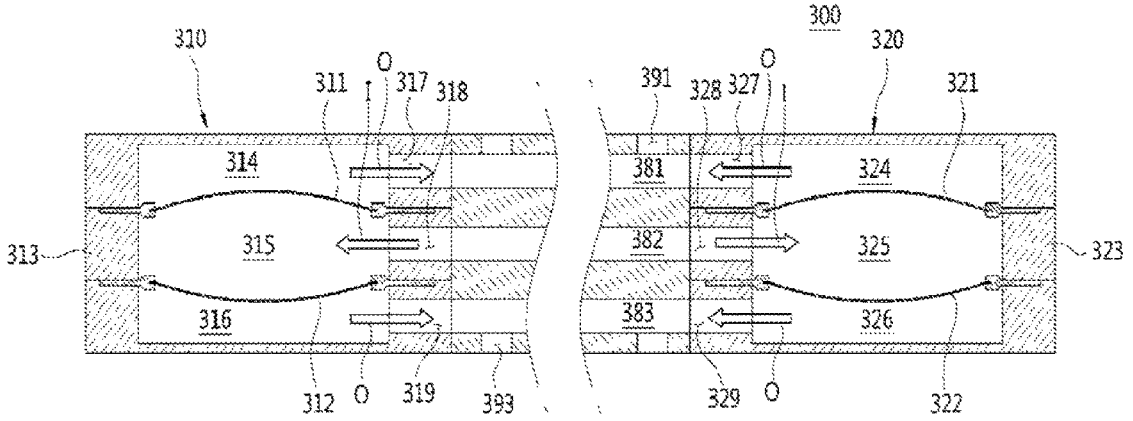
Figure 18:
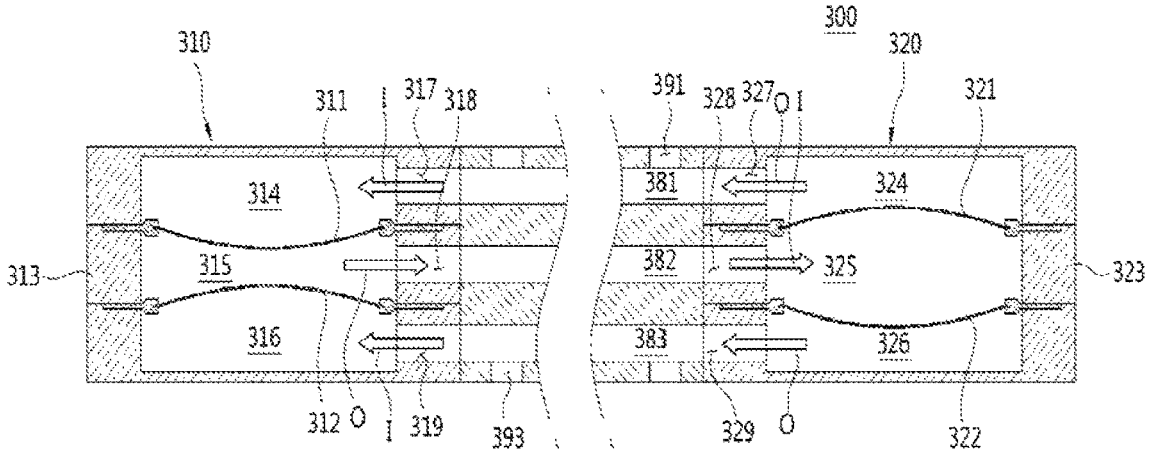
FIGS. 18 and 19 are views of the operation of the multi-pulsed jets generating apparatus in accordance with the third embodiment of the present invention, which describes the operation of the multi-pulsed jets generating apparatus in a mode in which corresponding actuators at both sides vibrate in opposite phases.
Figure 19:
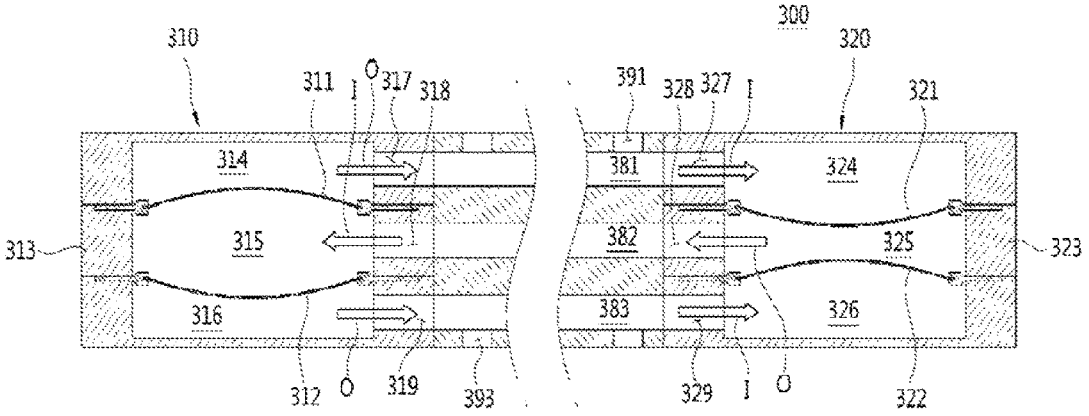

That is, the first diaphragm 311 and the third diaphragm 321 may vibrate in the same phase (see FIGS. 16 and 17) or different phases (see FIGS. 18 and 19). The second diaphragm 312 and the fourth diaphragm 322 may vibrate in the same phase (see FIGS. 16 and 17) or different phases (see FIGS. 18 and 19).

The manifold 360 may include a first inner passage 381, a second inner passage 382, and a third inner passage 383, a plurality of first injection ports 391 that communicate with the first inner passage 381, a plurality of second injection ports 392 that communicate with the second inner passage 382, and a plurality of third injection ports 393 that communicate with the third inner passage 393

The first inner passage 318 is disposed to communicate with the first cavity 314 and the fourth cavity 324 through the first orifice 317 and the fourth orifice 327, respectively. The second inner passage 382 is disposed to communicate with the second cavity 315 and the fifth cavity 325 through the second orifice 318 and the fifth orifice 328, respectively. The third inner passage 383 is disposed to communicate with the third cavity 316 and the sixth cavity 326 through the third orifice 319 and the sixth orifice 329, respectively.

The inner passages 381, 382, and 383 are closed spaces except for the orifices 317, 318, 319, 327, 328, and 329 and the injection ports 391, 392, and 393, and pressure changes of the cavities 314, 315, 316, 324, 325, and 326 may be transmitted to the inner passages 381, 382, and 383. Thus, pulsed jets may occur in the injection ports 391, 392, and 393.

Figure 16:
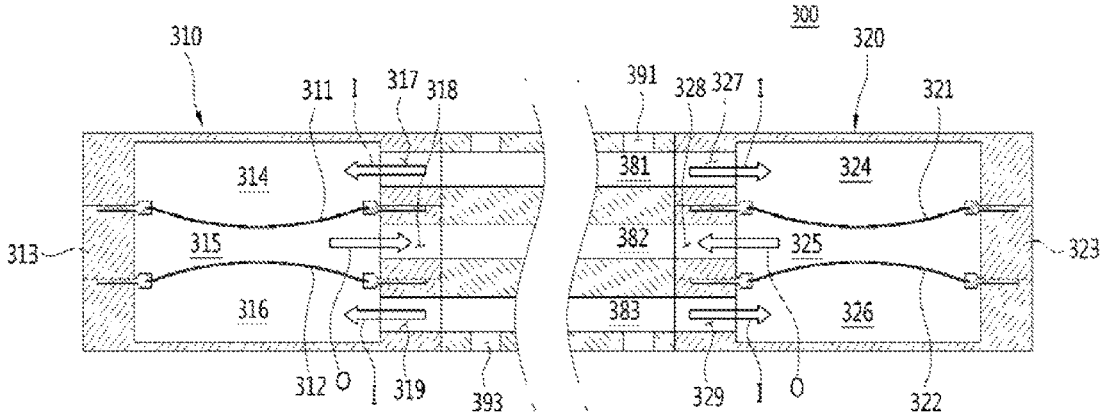
FIGS. 16 and 17 are views of an operation of the multi-pulsed jets generating apparatus in accordance with the third embodiment of the present invention, which describes the operation of the multi-pulsed jets generating apparatus in a mode in which corresponding actuators at both sides vibrate in the same phase.

FIGS. 16 and 17 are views of an operation of the multi-pulsed jets generating apparatus in accordance with the third embodiment of the present invention, which describes the operation of the multi-pulsed jets generating apparatus in a mode in which corresponding actuators at both sides vibrate in the same phase, and FIGS. 18 and 19 are views of the operation of the multi-pulsed jets generating apparatus in accordance with the third embodiment of the present invention, which describes the operation of the multi-pulsed jets generating apparatus in a mode in which corresponding actuators at both sides vibrate in opposite phases.

An operation of the multi-pulsed jets generating apparatus 300 in accordance with the third embodiment of the present invention will be described with reference to FIGS. 16 through 19.

The operation of the multi-pulsed jets generating apparatus 300 may be classified into two modes, i.e., a same phase vibration mode and an opposite phase vibration mode according to phases of the diaphragms 311, 312, 321, and 322 of the actuators 310 and 320.

The same phase vibration mode is a mode in which corresponding diaphragms among the diaphragms 311 and 312 of the first actuator 310 and diaphragms 321 and 322 of the second actuator 320 vibrate in the same phase.

As illustrated in FIG. 16, when the first diaphragm 311 is deformed to be convex toward the second cavity 315, the second diaphragm 312 is deformed to be convex toward the second cavity 315, the third diaphragm 321 is deformed to be convex toward the fifth cavity 325 and the fourth diaphragm 322 is deformed to be convex toward the fifth cavity 325, an inflow I occurs in the first orifice 317, the third orifice 319, the fourth orifice 327, and the sixth orifice 329, and an outflow O occurs in the second orifice 318 and the fifth orifice 328.

As illustrated in FIG. 17, when the first diaphragm 311 is deformed to be convex toward the first cavity 314, the second diaphragm 312 is deformed to be convex toward the third cavity 316, the third diaphragm 321 is deformed to be convex toward the fourth cavity 324 and the fourth diaphragm 323 is deformed to be convex toward the sixth cavity 326, an outflow O occurs in the first orifice 317, the third orifice 319, the fourth orifice 327, and the sixth orifice 329, and an inflow I occurs in the second orifice 318 and the fifth orifice 328.

The opposite phase vibration mode is a mode in which corresponding diaphragms among the diaphragms 311 and 312 of the first actuator 310 and the diaphragms 321 and 322 of the second actuator 320 vibrate in opposite phases.

As illustrated in FIG. 18, when the first diaphragm 311 is deformed to be convex toward the second cavity 315, the second diaphragm 312 is deformed to be convex toward the second cavity 315, the third diaphragm 321 is deformed to be convex toward the fourth cavity 324 and the fourth diaphragm 322 is deformed to be convex toward the sixth cavity 326, an inflow I occurs in the first orifice 317, the third orifice 319, and the fifth orifice 328, and an outflow O occurs in the second orifice 318, the fourth orifice 327, and the sixth orifice 329.

As illustrated in FIG. 19, when the first diaphragm 311 is deformed to be convex toward the first cavity 314, the second diaphragm 312 is deformed to be convex toward the third cavity 316, the third diaphragm 321 is deformed to be convex toward the fifth cavity 325 and the fourth diaphragm 322 is deformed to be convex toward the fifth cavity 325, an outflow O occurs in the first orifice 317, the third orifice 319, and the sixth orifice 328, and an inflow I occurs in the second orifice 318, the fourth orifice 327, and the sixth orifice 329.

Figure 20:
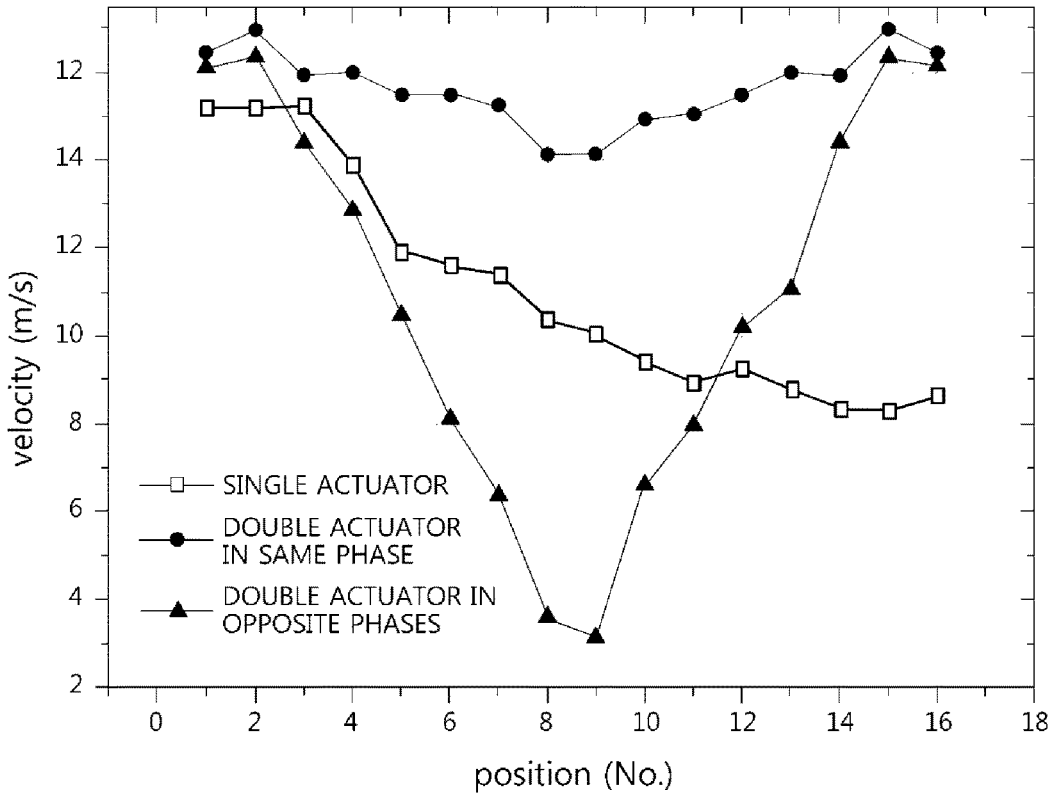
FIG. 20 is a view for comparing velocity of pulsed jets in a same phase vibration mode and an opposite phase vibration mode of the multi-pulsed jets generating apparatus in accordance with the third embodiment of the present invention with velocity of pulsed jets of the multi-pulsed jets generating apparatus in accordance with the second embodiment of the present invention.

FIG. 20 is a view for comparing velocity of pulsed jets in a same phase vibration mode and an opposite phase vibration mode of the multi-pulsed jets generating apparatus in accordance with the third embodiment of the present invention with velocity of pulsed jets of the multi-pulsed jets generating apparatus in accordance with the second embodiment of the present invention. In FIG. 20, a horizontal axis represents positions of injection ports, and a vertical axis represents RMS velocity of pulsed jets occurring in the injection ports. Here, the velocity of the pulsed jets is measured in the injection ports 292 and 392 that communicate with the inner passages 282 and 382 formed in the center of the multi-pulsed jets generating apparatuses 200 and 300.

Hereinafter, for convenience of explanation, the multi-pulsed jets generating apparatus 200 in accordance with the second embodiment of the present invention is referred to as a single actuator type multi-pulsed jets generating apparatus, and a same phase mode of the multi-pulsed jets generating apparatus 300 in accordance with the third embodiment of the present invention is referred to as a double actuator type same phase mode, and an opposite phase mode of the multi-pulsed jets generating apparatus 300 in accordance with the third embodiment of the present invention is referred to as a double actuator type opposite phase mode.

In the single actuator type multi-pulsed jets generating apparatus, it is assumed that total n injection ports 292 are disposed on the inner passage 282 of the manifold 260 and are defined as first, second, third, . . . , and n-th position injection ports from a sequence in which they are close to the actuator 210, to a sequence in which they are far away from the actuator 210.

Overall, the velocity of pulsed jets of the single actuator type multi-pulsed jets generating apparatus may be relatively large as the n injection ports are disposed to be closer to the actuator 210, and the velocity of the pulsed jets of the single actuator type multi-pulsed jets generating apparatus may be relatively small as the n injection ports are disposed to be farther away from the actuator 210. That is, the velocity of pulsed jets occurring in the first position injection port 292 (P1) (see FIG. 7) may be largest, and the velocity of pulsed jets occurring in the n-th position injection port 292 (Pn) (see FIG. 7) may be smallest. It may be interpreted that a pressure change of the cavity 235 is transmitted to the manifold 260, a pressure loss occurs as the n injection ports are farther away from the actuator 210.

Overall, the velocity of the pulsed jets may be formed to be left-right symmetrical based on a central injection port in the double actuator type same phase mode and the opposite phase mode.

The velocity of the pulsed jets in the double actuator type same phase mode may be usually larger than the velocity of the pulsed jets of the single actuator type multi-pulsed jets generating apparatus regardless of the position of the injection port 392. It may be interoperated that, in the single actuator type multi-pulsed jets generating apparatus, only a pressure change of one cavity 235 is reflected on the inner passage 273 of the manifold 260 but in the double actuator type same phase mode, pressure changes of the plurality of cavities 315 and 325 are added to each other and are reflected on the inner passage 382 of the manifold 370.

Also, the velocity of the pulsed jets in the double actuator type same phase mode may be usually constant regardless of the position of the injection port 392. That is, injection velocity in each injection port 392 may have some uniformity.

The velocity of the pulsed jets in the double actuator type opposite phase mode may be increased as the injection port 392 is disposed to be closer to the actuators 310 and 320, and the velocity of the pulsed jets in the double actuator type opposite phase mode may be decreased as the injection port 392 is disposed in the center of the manifold 360.

For example, the velocity of the pulsed jets in the double actuator type opposite phase mode may be similar to the velocity of the pulsed jets in the double actuator type same phase mode in the first position injection port 392 (P1) (see FIG. 14) and the n-th position injection port 392 (Pn) (see FIG. 14) but may be smaller than the velocity of the pulsed jets of the single actuator type multi-pulsed jets generating apparatus in the central injection port.

It may be interpreted that, in the double actuator type opposite phase mode, the pressure change of the cavity 315 at one side of the manifold 360 and the pressure change of the cavity 315 at the other side of the manifold 360 are offset.

In this way, injection velocity and uniformity of the pulsed jets in the injection ports may be set in various ways depending on whether an actuator is disposed only at one side of the manifold, or actuators are disposed at both sides of the manifold, or the actuators operate in the same phase when the actuators are disposed at both sides of the manifold, or the actuators operate in opposite phases when the actuators are disposed at both sides of the manifold.

Figure 21:
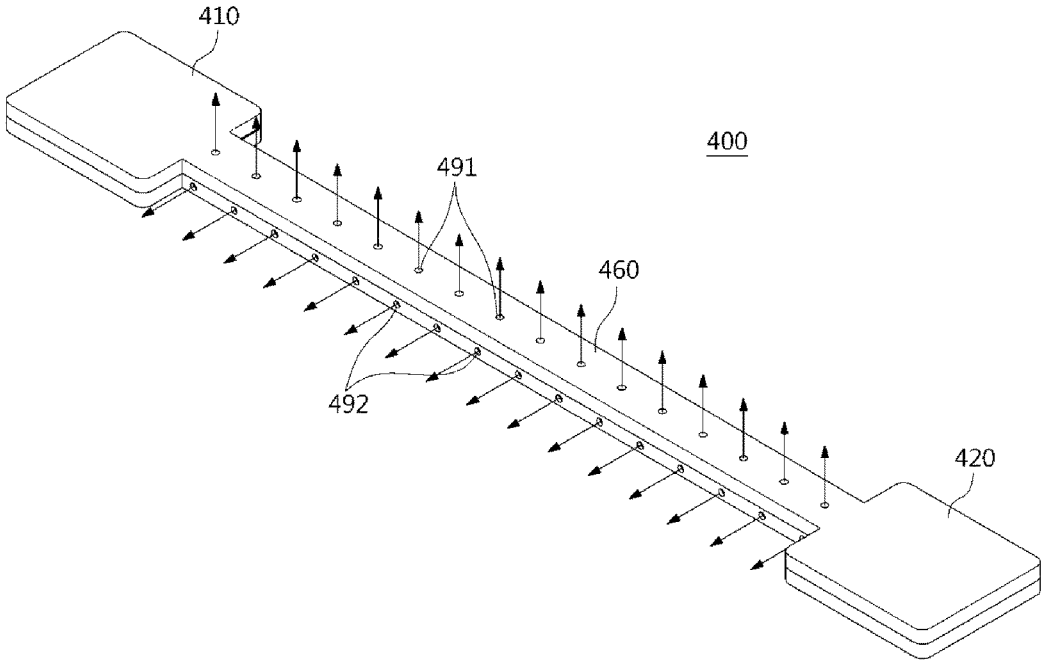
FIG. 21 is a perspective view of a multi-pulsed jets generating apparatus in accordance with a fourth embodiment of the present invention.
Figure 22:
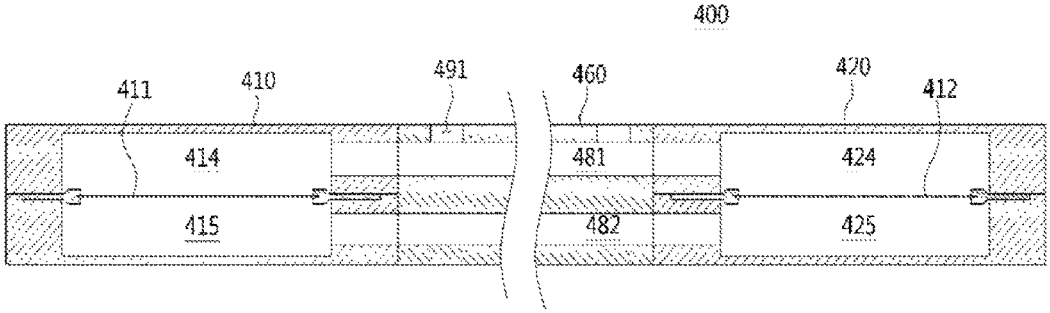
FIG. 22 is a schematic cross-sectional view of the entire configuration of the multi-pulsed jets generating apparatus in accordance with the fourth embodiment of the present invention.
Figure 23:
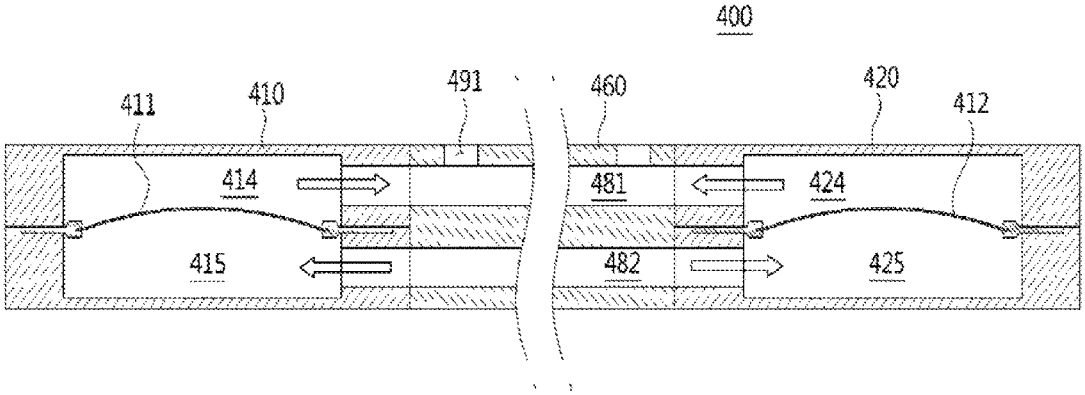
FIGS. 23 and 24 are views of an operation of the multi-pulsed jets generating apparatus in accordance with the fourth embodiment of the present invention, which describes the operation of the multi-pulsed jets generating apparatus in a mode in which actuators at both sides vibrate in the same phase.
Figure 24:
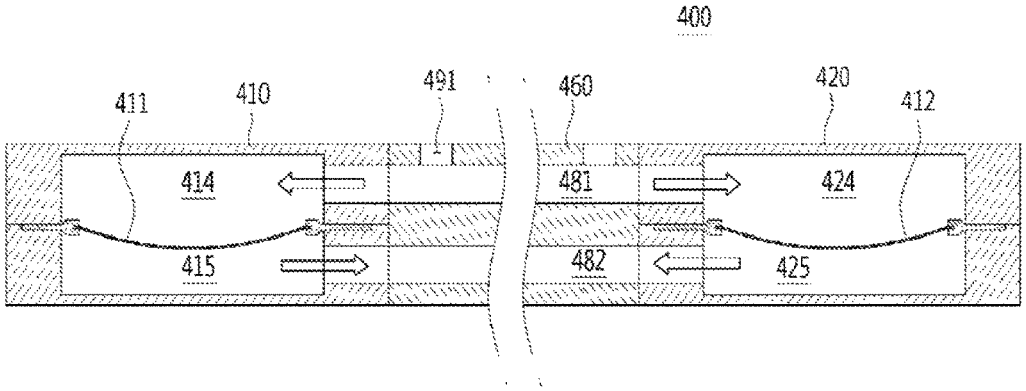
Figure 25:
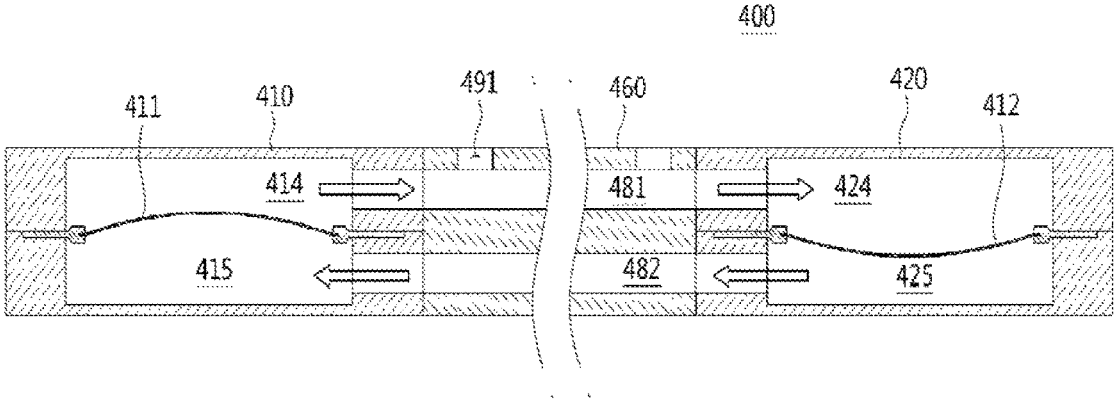
FIGS. 25 and 26 are views of the operation of the multi-pulsed jets generating apparatus in accordance with the fourth embodiment of the present invention, which describes the operation of the multi-pulsed jets generating apparatus in a mode in which actuators at both sides vibrate in opposite phases.
Figure 26:
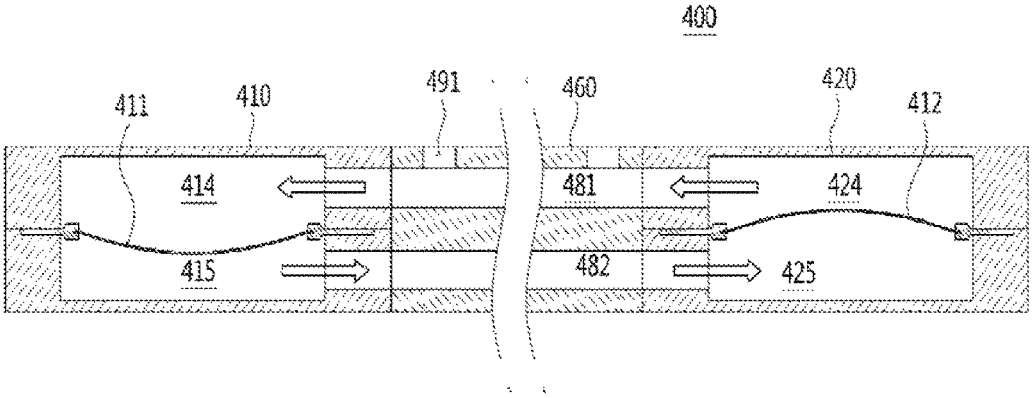

FIG. 21 is a perspective view of a multi-pulsed jets generating apparatus in accordance with a fourth embodiment of the present invention, and FIG. 22 is a schematic cross-sectional view of the entire configuration of the multi-pulsed jets generating apparatus in accordance with the fourth embodiment of the present invention. FIGS. 23 and 24 are views of an operation of the multi-pulsed jets generating apparatus in accordance with the fourth embodiment of the present invention, which describes the operation of the multi-pulsed jets generating apparatus in a mode in which actuators at both sides vibrate in the same phase. FIGS. 25 and 26 are views of the operation of the multi-pulsed jets generating apparatus in accordance with the fourth embodiment of the present invention, which describes the operation of the multi-pulsed jets generating apparatus in a mode in which actuators at both sides vibrate in opposite phases.

A multi-pulsed jets generating apparatus 400 in accordance with a fourth embodiment of the present invention will be described with reference to FIGS. 21 through 26. A description of the same configuration as those of the first through third embodiments of the present invention may be omitted.

The multi-pulsed jets generating apparatus 400 may include two actuators 410 and 420 each having one diaphragm 411 or 421 and a manifold 460 that connects the two actuators 410 and 420. That is, like in the third embodiment of the present invention, the actuators 410 and 420 are disposed at both sides of the manifold 460, respectively. However, each of the actuators 410 and 420 may include one diaphragm 411 or 421 and a plurality of cavities 414, 415, 424, and 425 divided by the diaphragm 411 or 421.

The manifold 460 may have a plurality of inner passages 481 and 482 that connect the plurality of cavities 414, 415, 424, and 425, and a plurality of injection ports 491 and 492 disposed to communicate with the plurality of inner passages 481 and 482.

As illustrated in FIGS. 23 and 24, both-side actuators 410 and 420 may vibrate in the same phase, and as illustrated in FIGS. 25 and 26, both-side actuators 410 and 420 may vibrate in opposite phases.

Although separately not shown, when both-side actuators 410 and 420 vibrate in the same phase, the velocity of pulsed jets injected from the injection ports 491 and 492 may be larger than the velocity of pulsed jets occurring in the single actuator method and may be uniform.

When both-side actuators 410 and 420 vibrate in opposite phases, the injection velocity of the pulsed jets injected from an injection port disposed close to the actuators 410 and 420 may be relatively larger than the injection velocity of the pulsed jets injected from an injection port disposed in the center of the manifold 460.

Of course, unlike the present embodiment, actuators may be disposed at both sides of the manifold so as to have one cavity and one orifice, respectively.

Figure 27:
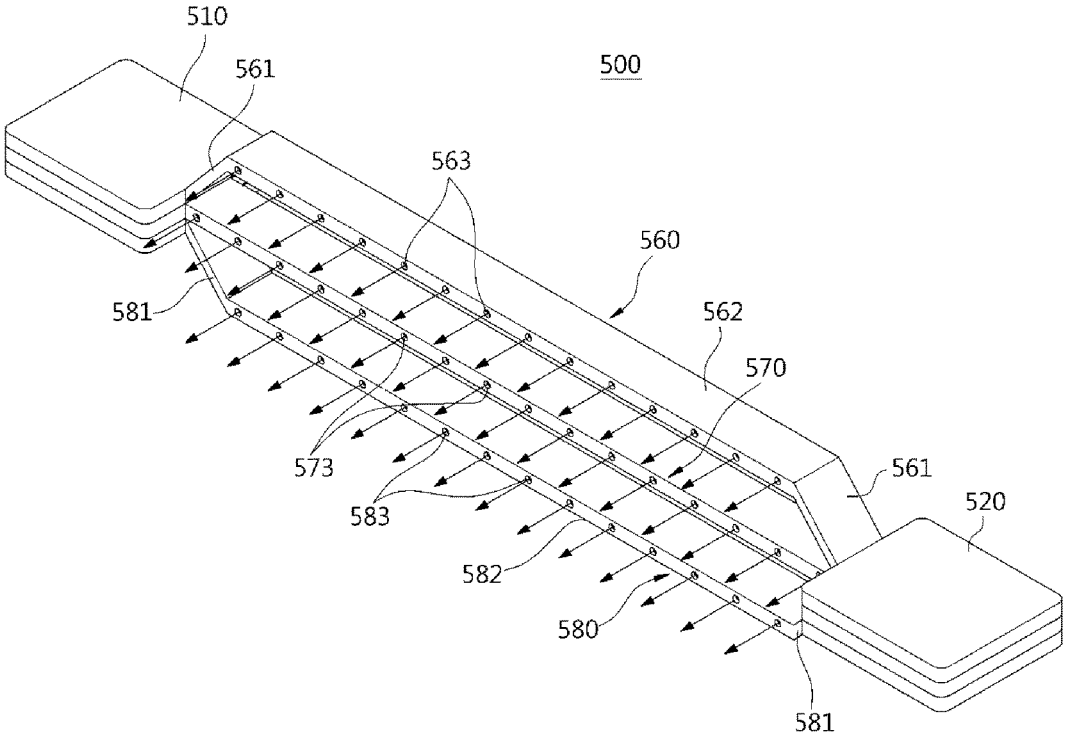
FIG. 27 is a perspective view of a multi-pulsed jets generating apparatus in accordance with a fifth embodiment of the present invention.

FIG. 27 is a perspective view of a multi-pulsed jets generating apparatus in accordance with a fifth embodiment of the present invention.

Referring to FIG. 27, a multi-pulsed jets generating apparatus 500 may include actuators 510 and 520 that generate pulsed jets using vibration of diaphragms and a plurality of manifolds 560, 570, and 580 that generate multi-pulsed jets in a large region by receiving the pulsed jets occurring in the actuators 510 and 520.

The plurality of manifolds 560, 570, and 580 may include a first manifold 570, a second manifold 580, and a third manifold 590. However, the number of manifolds is not limited, and the number of manifolds may be 2 or 4 or more. Empty spaces may be formed between the plurality of manifolds 560, 570, and 580. That is, the plurality of manifolds 560, 570, and 580 may be spaced a predetermined distance from each other.

Since the height of the actuators 510 and 520 is limited, the outside manifolds 560 and 580 may include inclination portions 561 and 581 disposed to be inclined in a direction in which the inclination portions 561 and 581 are widened outward, and rectilinear portions 562 and 582 parallel to the central manifold 570 so that the plurality of manifolds 560, 570, and 580 may be spaced apart from each other.

The plurality of manifolds 560, 570, and 580 may have inner passages that communicate with cavities of the actuators 510 and 520 and injection ports 563, 573, and 583 that communicate with the inner passages. The injection ports 563 and 583 may be disposed in the rectilinear portions 562 and 582.

In this way, the empty spaces are formed between the plurality of manifolds 560, 570, and 580, and the plurality of manifolds 560, 570, and 580 are disposed to be spaced apart from each other so that the inner passages of the manifolds 560, 570, and 580 may be spaced apart from each other and as such, the injection ports 563, 573, and 583 of the manifolds 560, 570, and 580 may be spaced apart from each other. That is, the first injection ports 563, the second injection ports 573, and the third injection ports 583 may be spaced apart from each other.

Through this configuration, even when the injection ports 563, 573, and 583 have the same injection angle, interference of the pulsed jets injected from the injection ports 563, 573, and 583 may be minimized. Thus, the air conditioner may be designed to have a thin shape and a small size in various ways.

Figure 28:
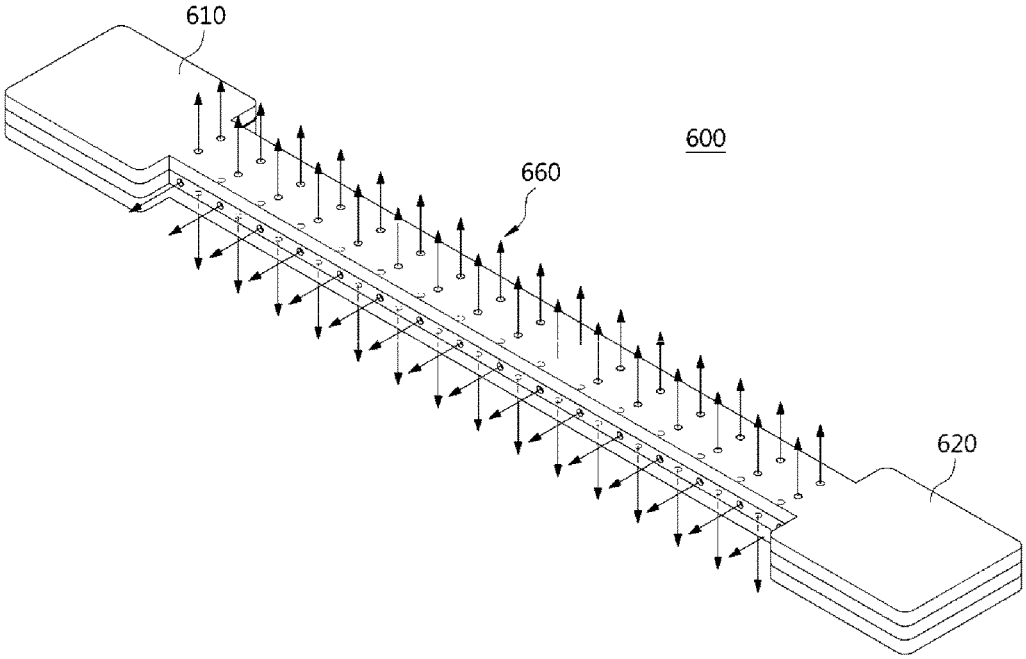
FIG. 28 is a perspective view of a multi-pulsed jets generating apparatus in accordance with a sixth embodiment of the present invention.
Figure 29:
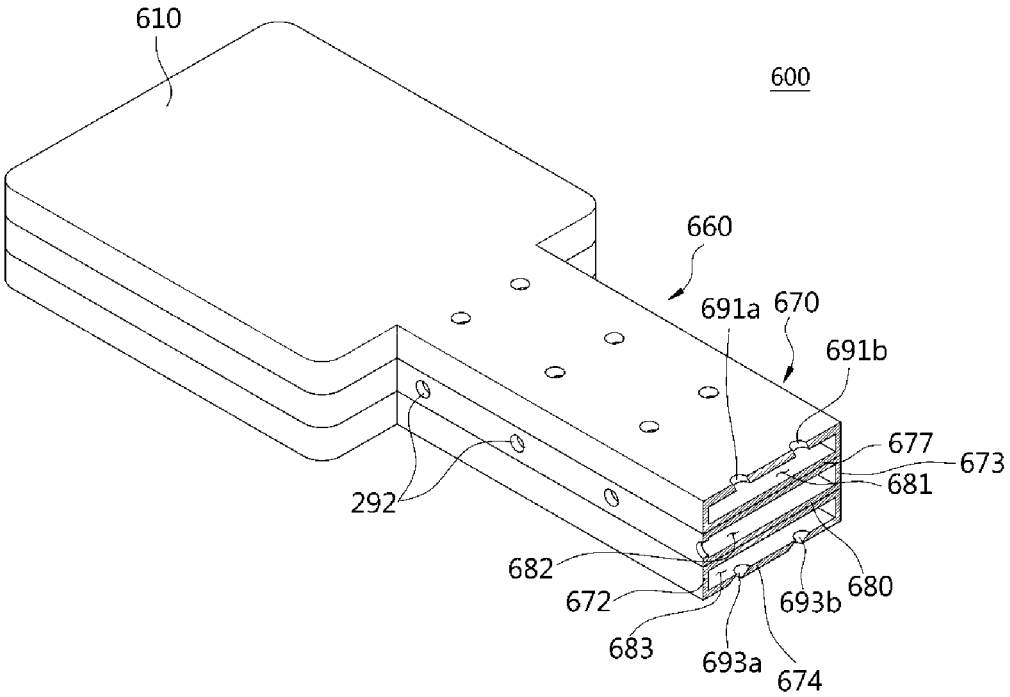
FIG. 29 is a cut perspective cross-sectional view of one side of a manifold of the multi-pulsed jets generating apparatus in accordance with the sixth embodiment of the present invention.

FIG. 28 is a perspective view of a multi-pulsed jets generating apparatus in accordance with a sixth embodiment of the present invention, and FIG. 29 is a cut perspective cross-sectional view of one side of a manifold of the multi-pulsed jets generating apparatus in accordance with the sixth embodiment of the present invention.

As illustrated in FIGS. 28 and 29, a manifold 660 of a multi-pulsed jets generating apparatus 600 may include inner passages 681, 682, and 683, injection ports 691*a*, 691*b*, 692, 693*a*, and 693*b* disposed to communicate with the inner passages 681, 682, and 683, partitioning walls 679 and 680 that partition the inner passages 681, 682, and 683, and an outer wall portion 670 disposed to surround the inner passages 681, 682, and 683. The outer wall portion 670 may include an upper wall 671, sidewalls 672 and 673, and a bottom wall 674.

First injection ports 691*a* and 691*b* may be formed on the upper wall 671 of the outer wall portion 670, and second injection ports 692 may be formed at one sidewall 672 of the outer wall portion 670, and third injection ports 693*a* and 693*b* may be formed on the bottom wall 674 of the outer wall portion 670. The first injection ports 691*a* and 691*b* and the third injection ports 693*a* and 693*b* may be arranged in two rows, i.e., front rows 691*a* and 693*a* and rear rows 691*b* and 693*b* along a lengthwise direction of the manifold 660.

The first injection ports 691*a* and 691*b* may be formed to pass through the upper wall 671 so as to communicate with the first inner passage 681 and the outside. The second injection ports 692 may be formed to pass through one sidewall 672 so as to communicate with the second inner passage 682 and the outside. The third injection ports 693*a* and 693*b* may be formed to pass through the bottom wall 674 so as to communicate with the third inner passage 683 and the outside.

The first injection ports 691*a* and 691*b* may be formed to be inclined with respect to the upper wall 671. The second injection ports 692 may be formed to be perpendicular to one sidewall 672. The third injection ports 693*a* and 693*b* may be formed to be inclined with respect to the bottom wall 674.

Through this configuration, interference between the pulsed jets injected from the injection ports 691*a*, 691*b*, 692, 693*a*, and 693*b* is minimized so that the direction of the pulsed jets may be set to be appropriate to the arrangement of the heat exchanger in various ways.

Figure 30:
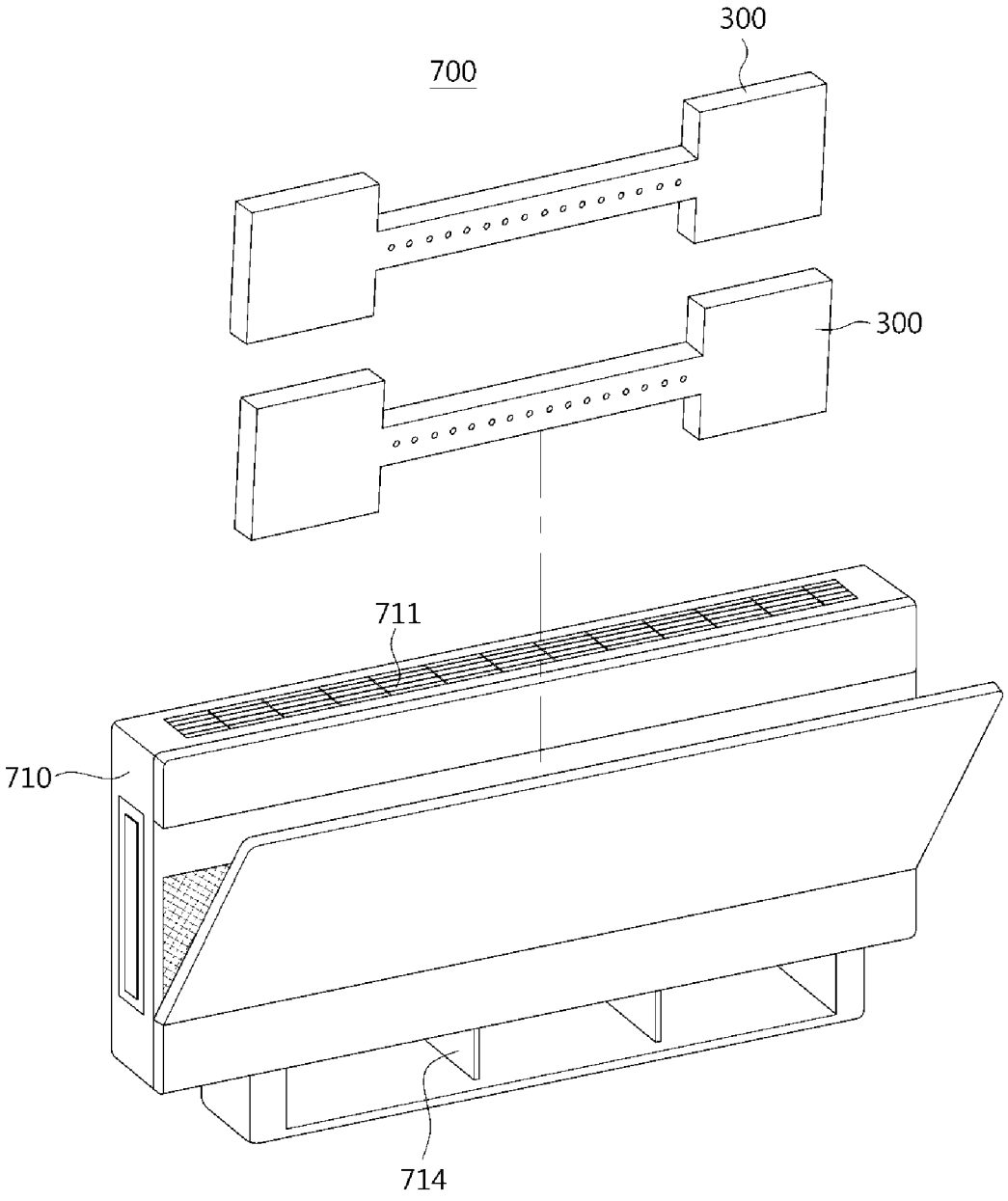
FIG. 30 is a view of an air conditioner to which the multi-pulsed jets generating apparatus in accordance with the third embodiment of the present invention is applied.
Figure 31:
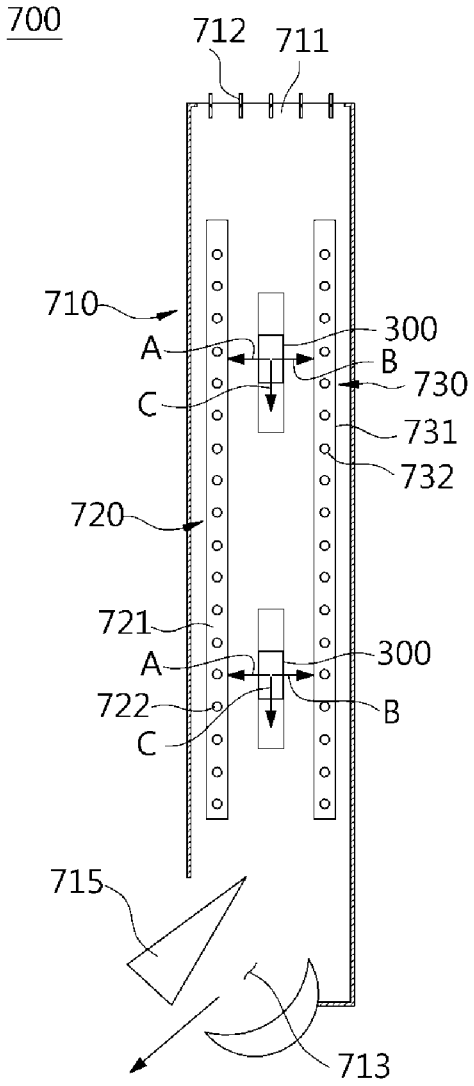
FIG. 31 is a cross-sectional view of a flow of air of the air conditioner illustrated in FIG. 30.

FIG. 30 is a view of an air conditioner to which the multi-pulsed jets generating apparatus in accordance with the third embodiment of the present invention is applied, and FIG. 31 is a cross-sectional view of a flow of air of the air conditioner illustrated in FIG. 30.

An air conditioner 700 may be one of an indoor unit disposed indoors and an outdoor unit disposed outdoors.

The air conditioner 700 includes a cabinet 710 that constitutes an exterior, heat exchangers 720 and 730 disposed in the cabinet 710 and heat-exchanges a refrigerant and an outside air, an inhalation port 711 that inhales the outside air, a discharge port 713 that discharges the air heat-exchanged by the heat exchangers 720 and 730, and a multi-pulsed jets generating apparatus 300 that forcibly flows the air.

The inhalation port 711 may be formed on a top end of the cabinet 710, and the discharge port 713 may be formed on a bottom end of the cabinet 710. A grill 712 may be disposed in the inhalation port 711 so as to block introduction of filth, and a direction adjustment wing 714 for changing the direction of discharged wind and a louver 715 that may open/close the discharge port 713 may be disposed in the discharge port 713 may be disposed in the discharge port 713.

A plurality of heat exchangers 720 and 730 may be mounted. The heat exchangers 720 and 730 may be disposed to be approximately parallel to each other by a predetermined distance. The heat exchangers 720 and 730 may have an approximately straight shape. Thus, this may be advantageous to the air conditioner having a thin shape and a small size. The heat exchangers 720 and 730 may include tubes 721 and 731 in which the refrigerant flows, and heat-exchanging fins 722 and 723 that are in contact with the tubes 721 and 731 so as to increase a heating area.

At least one multi-pulsed jets generating apparatus 300 may be disposed. The multi-pulsed jets generating apparatus 300 may be disposed between the plurality of heat exchangers 720 and 730. The multi-pulsed jets generating apparatus 300 may inject pulsed jets A, B, and C in three directions that are perpendicular to one another.

The first pulsed jets A may be injected toward one 720 of the plurality of heat exchangers 720 and 730, and the second pulsed jets B may be injected toward the other 730 of the plurality of heat exchangers 720 and 730, and the third pulsed jets C may be injected toward the discharge port 713.

Through this configuration, the air may flow from the inhalation port 711 to the discharge port 713 smoothly, and a sufficient contact area of the air and the heat exchangers and velocity of the pulsed jets are obtained so that effective heat-exchanging may be performed.

Figure 32:
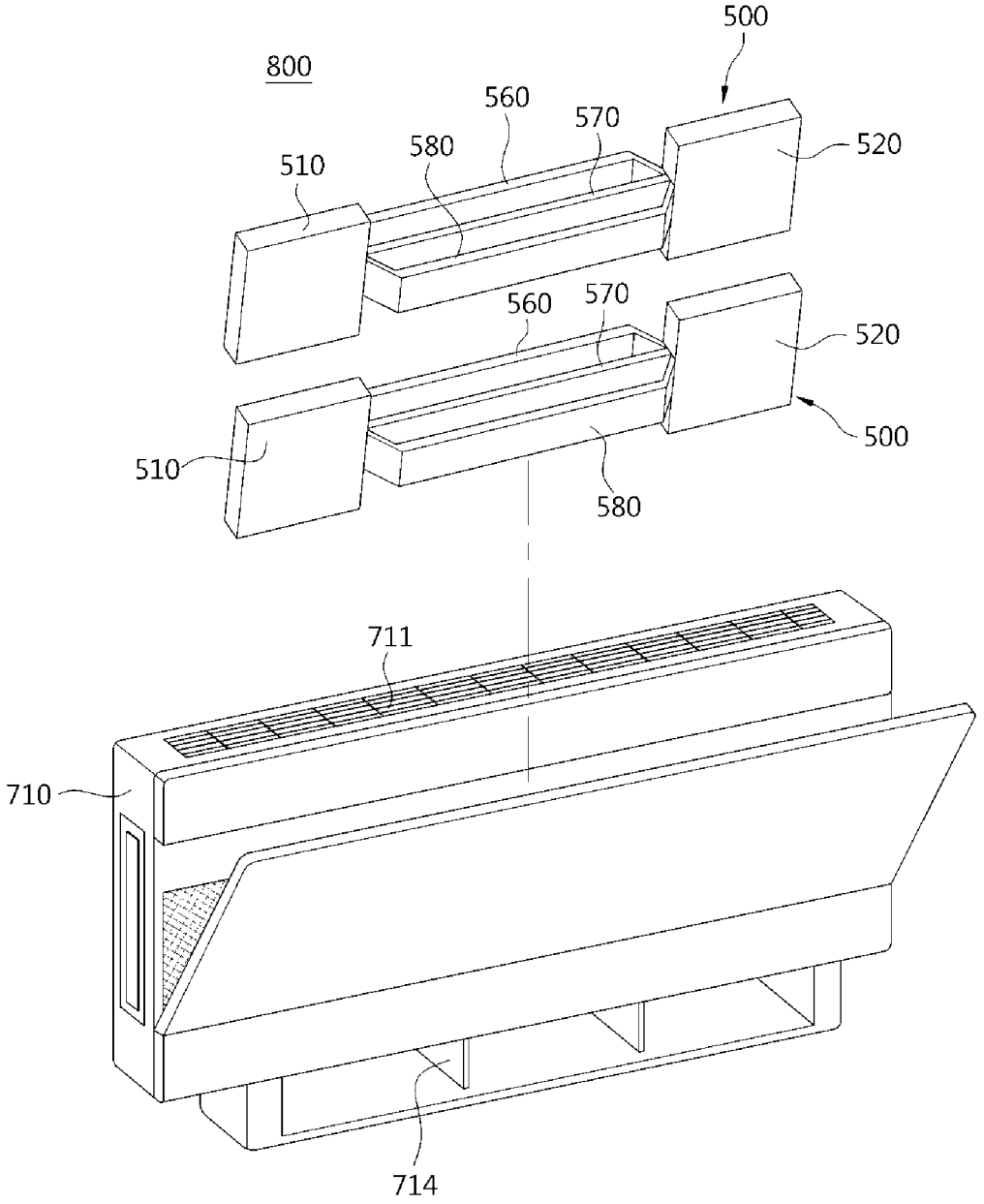
FIG. 32 is a view of an air conditioner to which the multi-pulsed jets generating apparatus in accordance with the fifth embodiment of the present invention is applied.
Figure 33:
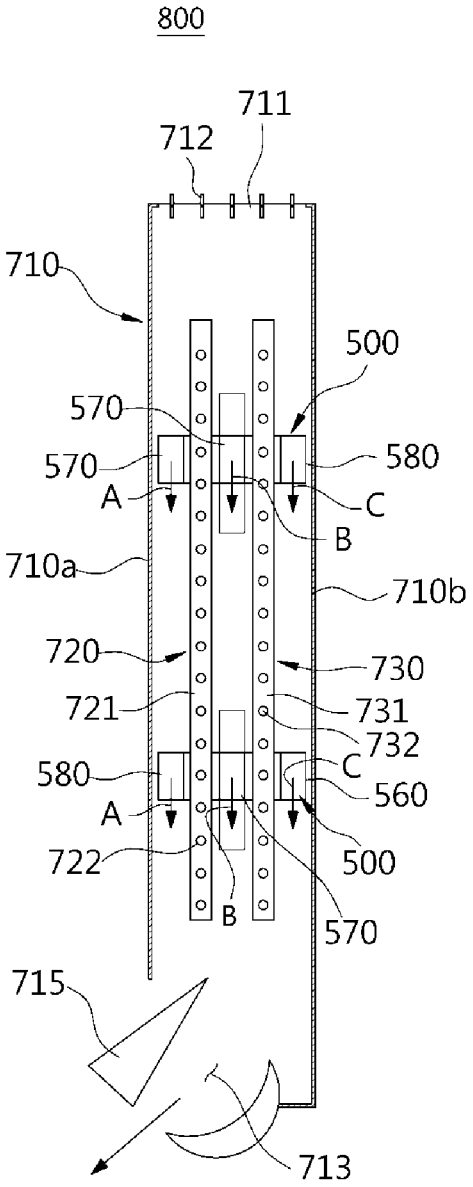
FIG. 33 is a cross-sectional view of a flow of air of the air conditioner illustrated in FIG. 32.

FIG. 32 is a view of an air conditioner to which the multi-pulsed jets generating apparatus in accordance with the fifth embodiment of the present invention is applied, and FIG. 33 is a cross-sectional view of a flow of air of the air conditioner illustrated in FIG. 32. Like reference numerals are used for a redundant configuration with the first through fourth embodiments, and a description thereof may be omitted.

An air conditioner 800 may include a multi-pulsed jets generating apparatus 500 having a plurality of manifolds 560, 570, and 580 disposed to be spaced apart from each other.

The multi-pulsed jets generating apparatus 500 may be disposed between a plurality of heat exchangers 720 and 730. Pulsed jets A, B, and C may be injected in three directions of the multi-pulsed jets generating apparatus 500. Directions of three pulsed jets A, B, and C may be the same. However, since the manifolds 560, 570, and 580 in which the pulsed jets A, B, and C occur, are spaced apart from each other, the pulsed jets A, B, and C are spaced apart from each other. Thus, mutual interference between the pulsed jets A, B, and C may be minimized.

The first manifold 560 may be disposed between a front surface 710*a* of the cabinet 710 and the first heat exchanger 720, and the second manifold 570 may be disposed between the first heat exchanger 720 and the second heat exchanger 730, and the third manifold 580 may be disposed between the second heat exchanger 730 and a rear surface 710*b* of the cabinet 710. The pulsed jets A, B, and C may be injected in a direction from the inhalation port 711 to the discharge port 713.

Figure 34:
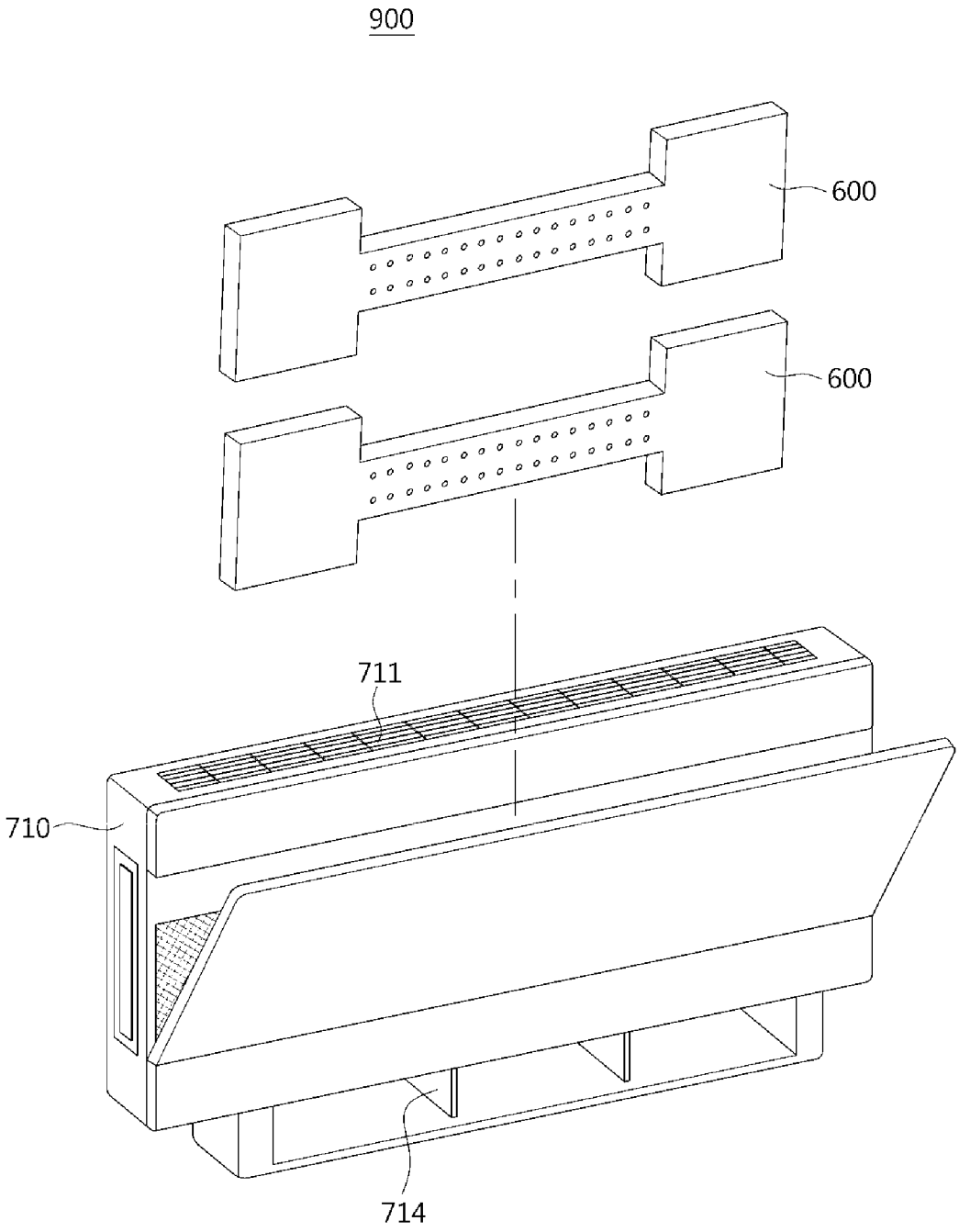
FIG. 34 is a view of an air conditioner to which the multi-pulsed jets generating apparatus in accordance with the sixth embodiment of the present invention is applied.
Figure 35:
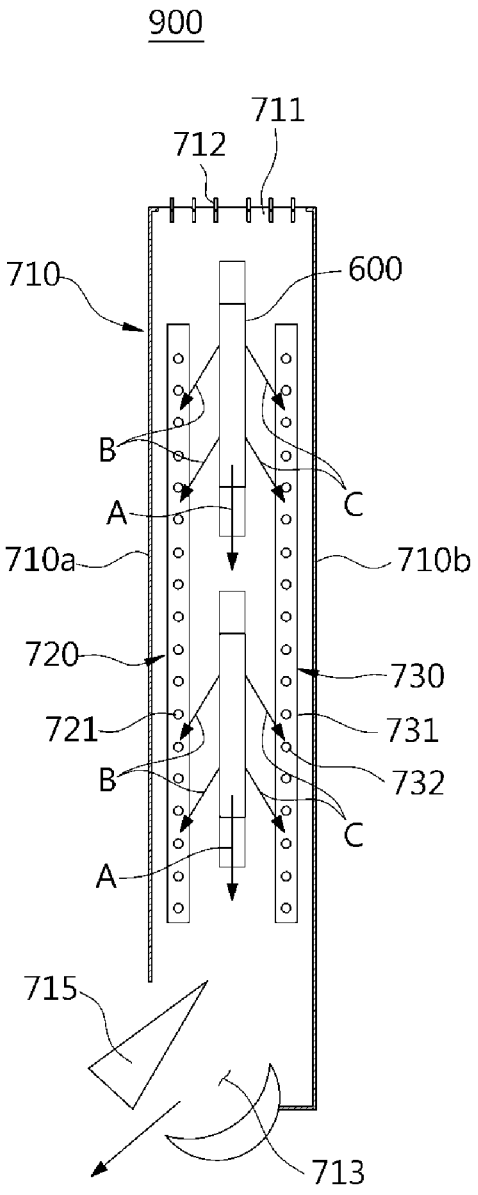
FIG. 35 is a cross-sectional view of a flow of air of the air conditioner illustrated in FIG. 34.

FIG. 34 is a view of an air conditioner to which the multi-pulsed jets generating apparatus in accordance with the sixth embodiment of the present invention is applied. FIG. 35 is a cross-sectional view of a flow of air of the air conditioner illustrated in FIG. 34. Like reference numerals are used for a redundant configuration with the first through fifth embodiments, and a description thereof may be omitted.

A multi-pulsed jets generating apparatus 900 may be disposed between a plurality of heat exchangers 720 and 730. The multi-pulsed jets generating apparatus 900 may inject pulsed jets A, B, and C in three directions.

The first pulsed jets A may be injected toward a discharge port 713. The second pulsed jets B and the third pulsed jets C may be injected to be downwardly inclined toward the heat exchangers 720 and 730.

While the disclosure has been shown and described with reference to certain exemplary embodiments thereof, it will be understood by those skilled in the art that various changes in form and details may be made therein without departing from the spirit and scope of the invention as defined by the appended claims and their equivalents.

The invention claimed is:

1. A multi-pulsed jets generating apparatus comprising:

at least one actuator including at least one diaphragm, a plurality of cavities and a plurality of orifices, and being configured so that each actuator includes at least two cavities that are contiguously arranged with a respective diaphragm separating each two adjacent cavities of the at least two cavities, and each cavity of the at least two cavities communicates with an outside of the actuator through a respective orifice, and the actuator generates a respective pulsed jet in each respective orifice through which each cavity of the at least two cavities communicates, according to a volume change of the at least two cavities caused by vibration of the diaphragm separating each two adjacent cavities of the at least two cavities; and a manifold, which is elongated, including a plurality of inner passages which are contiguously arranged, and a plurality of injection ports which include a respective multiple number of injection ports for each inner passage, and that are arranged so that the multiple number of injection ports for each inner passage are at different positions along an axis in which the manifold is elongated, or have different injection angles, than the multiple number of injection ports for an adjacent inner passage, wherein each inner passage communicates with a respective cavity of the at least two cavities of each actuator through the respective orifice through which the respective cavity communicates, to receive the pulsed jet generated in the orifice, and generates a plurality of pulsed jets that are output through the multiple number of input ports for the inner passage, so that the manifold thereby generates multi-pulsed jets which are output through the plurality of injection ports.

2. The multi-pulsed jets generating apparatus of claim 1, wherein the at least one actuator comprises a first actuator and a second actuator disposed on different ends of the manifold.

3. The multi-pulsed jets generating apparatus of claim 2, wherein the first actuator and the second actuator generate pulsed jets by operating in the same phase.

4. The multi-pulsed jets generating apparatus of claim 2, wherein the first actuator and the second actuator generate pulsed jets by operating in opposite phases.

5. The multi-pulsed jets generating apparatus of claim 2, wherein the first actuator and the second actuator generate pulsed jets in opposite directions.

6. The multi-pulsed jets generating apparatus of claim 1, wherein the manifold is elongated in an injection direction of the pulsed jets generated in the orifices.

7. The multi-pulsed jets generating apparatus of claim 1, wherein the pulsed jets generated in the orifices are injected to the inner passages in the same direction.

8. The multi-pulsed jets generating apparatus of claim 1, wherein the pulsed jets generated in the orifices are obliquely injected with respect to a lengthwise direction of the inner passage.

9. The multi-pulsed jets generating apparatus of claim 1, wherein each actuator of the at least one actuator comprises a housing in which the at least two cavities included in the actuator are formed, and the respective diaphragm separating the at least two cavities is mounted in the housing.

10. The multi-pulsed jets generating apparatus of claim 9, wherein the at least one diaphragm comprises a first diaphragm and a second diaphragm, the plurality of cavities comprise a first cavity, a second cavity, and a third cavity, and the first cavity and the second cavity are partitioned by the first diaphragm, and volumes of the first cavity and the second cavity change by vibration of the first diaphragm, and the second cavity and the third cavity are partitioned by the second diaphragm, and volumes of the second cavity and the third cavity change by vibration of the second diaphragm.

11. An air conditioner comprising:

a cabinet having an inhalation port and a discharge port;

at least one heat exchanger disposed in the cabinet; and a multi-pulsed jets generating apparatus including:

at least one actuator including at least one diaphragm, a plurality of cavities and a plurality of orifices, and being configured so that each actuator includes at least two cavities that are contiguously arranged with a respective diaphragm separating each two adjacent cavities of the at least two cavities, and each cavity of the at least two cavities communicates with an outside of the actuator through a respective orifice, and the actuator generates a respective pulsed jet in each respective orifice through which each cavity of the at least two cavities communicates, according to a volume change of the at least two cavities caused by vibration of the diaphragm separating each two adjacent cavities of the at least two cavities, and a manifold, which is elongated, including a plurality of inner passages which are contiguously arranged, and a plurality of injection ports which include a respective multiple number of injection ports for each inner passage, and that are arranged so that the multiple number of injection ports for each inner passage are at different positions along an axis in which the manifold is elongated, or have different injection angles, than the multiple number of injection ports for an adjacent inner passage, wherein each inner passage communicates with a respective cavity of the at least two cavities of each actuator through the respective orifice through which the respective cavity communicates, to receive the pulsed jet generated in the orifice, and generates a plurality of pulsed jets that are output through the multiple number of input ports for the inner passage, so that the manifold thereby generates multi-pulsed jets which are output through the plurality of injection ports.

12. The air conditioner of claim 11, wherein the at least one actuator comprises a first actuator and a second actuator disposed on different ends of the manifold.

13. The air conditioner of claim 12, wherein the first actuator and the second actuator generate pulsed jets by operating in the same phase.

14. The air conditioner of claim 12, wherein the first actuator and the second actuator generate pulsed jets by operating in opposite phases.

15. The air conditioner of claim 11, wherein the manifold comprises a plurality of manifolds.

16. An apparatus comprising:

a first actuator including first and second cavities that are adjacent to each other;

a first diaphragm separating the first and second cavities, a first orifice through which the first cavity communicates to an outside of the first actuator, and a second orifice through which the second cavity communicates to an outside of the first actuator, wherein the first actuator is configured so that the first actuator generates a first pulsed jet in the first orifice and a second pulsed jet in the second orifice according to a volume change of the first and second cavities caused by vibration of the first diaphragm; and a manifold, which is elongated, including first and second inner passages that are adjacent to each other, a first plurality of injection ports for the first inner passage, and a second plurality of injection ports for the second inner passage, wherein the first plurality of injection ports are at different positions along an axis in which the manifold is elongated, or have different injection angles, than the second plurality of injection ports, and the first inner passage communicates with the first cavity through the first orifice to receive the pulsed jet generated in the first orifice, and generates a plurality of pulsed jets that are output through the first plurality of injection ports, and the second inner passage communicates with the second cavity through the second orifice to receive the pulsed jet generated in the second orifice, and generates a plurality of pulsed jets that are output through the second plurality of injection ports, so that the manifold thereby generates multi-pulsed jets which are output through the first and second plurality of injection ports.

17. The apparatus of claim 16, wherein the first actuator further comprises:

a third cavity adjacent to the second cavity, a second diaphragm separating the second and third cavities, and a third orifice through which the third cavity communicates to an outside of the first actuator, wherein the first actuator is configured so that the first actuator generates a third pulsed jet in the third orifice according to a volume change of the second and third cavities caused by vibration of the second diaphragm, and the manifold includes a third inner passage that is adjacent to the second inner passage, and a third plurality of injection ports for the third inner passage and that are at different positions along the axis in which the manifold is elongated, or have different injection angles, than the second plurality of injection ports, wherein the third inner passage communicates with the third cavity through the third orifice to receive the pulsed jet generated in the third orifice, and generates a plurality of pulsed jets that are output through the third plurality of injection ports.

18. The apparatus of claim 16, further comprising:

a second actuator including first and second cavities that are adjacent to each other;

a first diaphragm separating the first and second cavities, a first orifice through which the first cavity communicates to an outside of the second actuator, and a second orifice through which the second cavity communicates to an outside of the second actuator, wherein the second actuator is configured so that the second actuator generates a first pulsed jet in the first orifice and a second pulsed jet in the second orifice according to a volume change of the first and second cavities caused by vibration of the first diaphragm, the first inner passage of the manifold communicates with the first cavity of the second actuator through the first orifice of the second actuator to receive the pulsed jet generated in the first orifice of the second actuator, and the second inner passage of the manifold communicates with the second cavity of the second actuator through the second orifice of the second actuator to receive the pulsed jet generated in the second orifice of the second actuator.

* * * * *